US010030312B2

(12) United States Patent
Ruan et al.

(10) Patent No.: US 10,030,312 B2
(45) Date of Patent: Jul. 24, 2018

(54) ELECTRODEPOSITED ALLOYS AND METHODS OF MAKING SAME USING POWER PULSES

(75) Inventors: Shiyun Ruan, Cambridge, MA (US); Christopher A. Schuh, Ashland, MA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 630 days.

(21) Appl. No.: 12/579,062

(22) Filed: Oct. 14, 2009

(65) Prior Publication Data

US 2011/0083967 A1 Apr. 14, 2011

(51) Int. Cl.
*C25D 5/18* (2006.01)
*C25D 3/66* (2006.01)
(Continued)

(52) U.S. Cl.
CPC ..... *C25D 3/665* (2013.01); *C25C 3/06* (2013.01); *C25C 3/18* (2013.01); *C25D 3/66* (2013.01);
(Continued)

(58) Field of Classification Search
CPC ..... C25D 3/665
(Continued)

(56) References Cited

U.S. PATENT DOCUMENTS 3,183,376 A 5/1965 Boyer et al.
3,268,422 A * 8/1966 Smith ..... C25D 3/66 204/293
(Continued)

FOREIGN PATENT DOCUMENTS

CN 1729314 A 2/2006
CN 102656295 B 1/2016
(Continued)

OTHER PUBLICATIONS

Tsuda, T.; Hussey, C.L.; Stafford, G.R.; Kongstein, O.: Electrodeposition of Al—Zr Alloys from Lewis Acidic Aluminum Chloride-1-Ethyl-3-methylimidazolium Chloride Melt. Journal of the Electrochemical Society, 151, (7) C447-C454, 2004.*
(Continued)

*Primary Examiner* — Brian W Cohen
(74) *Attorney, Agent, or Firm* — Steven J. Weissburg

(57) ABSTRACT

Power pulsing, such as current pulsing, is used to control the structures of metals and alloys electrodeposited in non-aqueous electrolytes. Using waveforms containing different types of pulses: cathodic, off-time and anodic, internal microstructure, such as grain size, phase composition, phase domain size, phase arrangement or distribution and surface morphologies of the as-deposited alloys can be tailored. Additionally, these alloys exhibit superior macroscopic mechanical properties, such as strength, hardness, ductility and density. Waveform shape methods can produce aluminum alloys that are comparably hard (about 5 GPa and as ductile (about 13% elongation at fracture) as steel yet nearly as light as aluminum; or, stated differently, harder than aluminum alloys, yet lighter than steel, at a similar ductility. Al—Mn alloys have been made with such strength to weight ratios. Additional properties can be controlled, using the shape of the current waveform.

19 Claims, 13 Drawing Sheets

(51) Int. Cl.

| | |
|---|---|
| ***C25C 3/06*** | (2006.01) |
| ***C25C 3/18*** | (2006.01) |
| ***C25D 21/12*** | (2006.01) |
| ***C25D 5/10*** | (2006.01) |
| *C25D 3/44* | (2006.01) |
| *C25D 3/56* | (2006.01) |

(52) U.S. Cl.
CPC ..... *C25D 5/10* (2013.01); *C25D 5/18* (2013.01); *C25D 21/12* (2013.01); *C25D 3/44* (2013.01); *C25D 3/56* (2013.01)

(58) Field of Classification Search
USPC ..... 205/237, 234, 236, 176, 170, 84
See application file for complete search history.

(56) References Cited

U.S. PATENT DOCUMENTS

| | | | |
|---|---|---|---|
| 4,652,348 | A | 3/1987 | Yahalom et al. |
| 5,489,488 | A | 2/1996 | Asai et al. |
| 6,036,833 | A | 3/2000 | Tang et al. |
| 6,210,555 | B1 | 4/2001 | Taylor et al. |
| 6,319,384 | B1 | 11/2001 | Taylor et al. |
| 6,723,219 | B2 | 4/2004 | Collins |
| 7,425,255 | B2 | 9/2008 | Detor et al. |
| 2004/0140220 | A1 | 7/2004 | Fischer |
| 2006/0272949 | A1 | 12/2006 | Detor et al. |

FOREIGN PATENT DOCUMENTS

| | | | | | |
|---|---|---|---|---|---|
| JP | 2008-195990 | | | 8/2008 | |
| JP | 2008-195990 | A | | 8/2008 | |
| JP | 2008195990 | A | * | 8/2008 | |
| JP | 2009-173977 | | | 8/2009 | |
| JP | 2009197318 | A | * | 9/2009 | |
| WO | WO 2008127110 | A1 | * | 10/2008 | ..... C25D 5/10 |
| WO | WO 2008127111 | A1 | * | 10/2008 | ..... C25D 5/56 |

OTHER PUBLICATIONS

Machine translation of JP 2009-173977 of Inoue et al., published on Aug. 6, 2009.*

Translation of JP 2009-197318 of Inoue et al.*

International Search Report and Written Opinion dated May 13, 2011. PCT/US 2010/051630. International Filing Date Oct. 6, 2010.

Endres F, Bukowski M, Hempelmann R, Natter H. Angew. Electrodeposition of Noncrystalline metals and alloys from ionic liquids. Angew. Chem.-Int. Edit. 2003;42:3428-30.

Fei J-Y, Wilcox GD. Electrodeposition of Zn—Co alloys with pulse containing reverse current. Electrochimica Acta 2005;50:2693.

Natter H, Bukowski M, Hempelmann R, El Abedin SZ, Moustafa EM, Endres F. Electrochemical Deposition of Nanostructured Metals and Alloys from Ionic Liquids. Zeitschrift Fur Physikalische Chemie-International Journal of Research in Physical Chemistry & Chemical Physics 2006;220:1275.

Detor Andrew J., Schuh Christopher A. Tailoring and patterning the grain size of nanocrystalline alloys. Acta Materialia 2007;55:371.

Ruan Shiyun, Schuh Christopher A. Mesoscale structure and segregation in electrodeposited nanocrystalline alloys. Scripta Materialia 2008;59:1218.

Ruan Shiyun, Schuh Christopher A. Electrodeposited Al—Mn alloys with microcrystalline, nanocrystalline, amorphous and nano-quasicrystalline structures. Acta Materialia 2009; 57: 3810-22.

Manoli Georgia, Chryssoulakis Yannis, Poignet Jean-Claude. Study of Pulsed Electrolytic Deposition of Aluminum onto Aluminum, Platinum and Iron Electrodes. Plating and Surface Finishing 1991; 64-69.

Notification of Refusal from the Japanese Patent Office dated Jul. 9, 2014. The Japanese Patent Application No. 2012-534225 claims priority to PCT/US2010/51630 which claims priority to the present application.

Examination and Search Report from the Taiwan Intellectual Property Office dated Nov. 21, 2014. The Taiwanese Patent Application No. 099134842 claims priority to the present application.

First Office Action from the State Intellectual Property Office, P.R. China dated Apr. 21, 2014. The Chinese Patent Application No. 201080056343.X claims priority to PCT/US2010/51630 which claims priority to the present application.

Search Report from the State Intellectual Property Office, P.R. China dated Apr. 9, 2014. The Chinese Patent Application No. 201080056343.X claims priority to PCT/US2010/51630 which claims priority to the present application.

Second Office Action from the State Intellectual Property Office, P.R. China dated Feb. 10, 2015. The Chinese Patent Application No. 201080056343.X claims priority to PCT/US2010/51630 which claims priority to the present application.

Communication pursuant to Article 94(3) EPC mailed by the European Patent Office dated Oct. 12, 2016. The European Application No. 10 765 721.5-1359 claims priority to PCT/US2010/51630 which claims priority to the present application.

Examination and Search Report mailed by the Taiwan Intellectual Property Office dated Jun. 17, 2015. The Taiwanese Application No. 099134842, issued Mar. 21, 2016 as Patent No. 1526853, claims priority to to the present application.

Decision of Refusal mailed by the Japanese Patent Office dated May 26, 2015. The Japanese Application No. 2012-534225, claims priority to PCT/US2010/51630, which claims priority to the present application.

Notice of Preliminary Rejection mailed by the Korean Intellectual Property Office dated Jun. 15, 2016. The Korean Application No. 10-2012-7012278, claims priority to PCT/US2010/51630 which claims priority to the present application.

Examination Report mailed by the Canadian Intellectual Property Office dated Aug. 25, 2016. The Canadian Application No. 2,774,585, claims priority to PCT/US2010/51630, which claims priority to the present application.

Communication pursuant to Article 94(3) EPC mailed by the European Patent Office dated Apr. 19, 2017. The European Application No. 10 765 721.5-1373 claims priority to PCT/US2010/51630, which claims priority to the present application.

Notice of Allowance mailed by the Taiwan Intellectual Property dated Dec. 31, 2015. The Taiwanese Application No. 099134842, issued Mar. 21, 2016 as Patent No. 1526853, claims priority to to the present application.

Decision of Refusal mailed by the Japanese Patent Office dated Oct. 11, 2016 The Japanese Application No. 2015-185199, claims priority to PCT/US2010/51630, which claims priority to the present application.

Decision of Refusal mailed by the Japanese Patent Office dated May 9, 2017. The Japanese Application No. 2015-185199, claims priority to PCT/US2010/51630, which claims priority to the present application.

Notice of Allowance from the Korean Intellectual Property Office dated Apr. 24, 2017. The Korean Application No. 10-2012-7012278, (now Patent No. 10-1739547) claims priority to PCT/US2010/51630 which claims priority to the present application.

Office Action and Search Report mailed by the State Intellectual Property Office, P.R. China dated May 5, 2017. The Chinese application No. 201510815253.9 claims priority to PCT/US2010/51630, which claims priority to the present application.

Article in ScienceDirect (Received Mar. 10, 2009; available on-line May 21, 2009) by Shiyun Ruan and Christopher Schuh, entitled Electrodeposited Al—Mn alloys with microcrystalline, nanocrystalline, amorphous and nano-quasicrystalline structures.

* cited by examiner

ELECTRODEPOSITED ALLOYS AND METHODS OF MAKING SAME USING POWER PULSES

GOVERNMENT RIGHTS

This invention was made with Government support under Contract No. W911NF-07-D-0004 awarded by the Army Research Office. The United States Government has certain rights in the invention.

BACKGROUND

Metals and alloys with desirable mechanical, magnetic, electronic, optical, or biological properties enjoy wide applications throughout many industries. Many physical and/or mechanical properties, such as strength, hardness, ductility, toughness, electrical resistance etc., depend on the internal morphological structure of the metal or alloy.

The internal structure of a metal or alloy is often referred to as its microstructure, although the micro-prefix is not intended here to limit the scale of the structure in any way. As used herein, the microstructure of an alloy is defined by the various phases, grains, grain boundaries and defects that make up the internal structure of the alloy, and their arrangement within the metal or alloy. There may be more than one phase, and grains and phases or phase domains may exhibit characteristic sizes that range from nanometers to, for example, millimeters. For single phase crystalline metals and alloys, one of the most important microstructural characteristics is grain size. For metals and alloys that exhibit multiple phases, their properties also depend on internal morphological properties, such as phase composition, phase domain sizes, and phase spatial arrangement or phase distribution. Therefore, it is of great practical interest to tailor the grain sizes of metals and alloys, across a wide range that spans from micrometers down to nanometers, as well as their phase compositions, phase domain sizes, and phase arrangements or phase distributions. However, in many cases, it is not understood exactly, or even generally, how a change in internal morphological properties, such as phase composition or microstructure will affect such physical properties. Thus, it is not sufficient simply to know how to tailor phase composition or microstructure.

It is very useful in characterizing a microstructure, to define a characteristic microstructural length scale. In the case of metals and alloys that are polycrystalline, the characteristic length scale as used herein refers to the average grain size. For microstructures containing subgrains (i.e. regions within a crystal that differ slightly in orientation to one another), the characteristic length scale as used herein can also refer to the subgrain size. Metals and alloys can also contain twin defects, which are formed when adjacent grains or subgrains are misoriented in a specific symmetric way. For such metals and alloys, the characteristic length scale as used herein can refer to the spacing between these twin defects. Metals and alloys can also contain many different phases, such as different types of crystalline phases (such as face-centered cubic, body-centered cubic, hexagonal close-packed, or specific ordered intermetallic structures), as well as amorphous and quasi-crystalline phases. For such metals and alloys, the characteristic length scale as used herein can refer to the average separation between the different phases, or the average characteristic size of each phase domain.

Additionally, there are many properties, such as optical luster, wettability with various liquids, coefficient of friction and corrosion resistance that depend on the surface morphologies of metals and alloys. Thus, the ability to tailor the surface morphologies of metals and alloys is also pertinent and valuable. However, in many cases it is not understood exactly, or even generally, how a change in surface morphology will affect these other properties. In general, as used herein, the term morphological properties may be used to refer to both surface morphology, and also to internal morphology.

There are many existing techniques that are capable of fabricating metals and alloys of different microstructures, including severe deformation processing methods, mechanical milling, novel recrystallization or crystallization pathways, vapor phase deposition, and electrochemical deposition (herein called electrodeposition).

However, many of these processing techniques have drawbacks. Some cannot provide a product of any desired shape, but rather are limited to relatively simple shapes such as sheets, rolls, plates, slugs, etc. Some cannot be used to make relatively large parts, without expending undue amounts of energy. Others provide some end product microstructures, but the control over such microstructures is relatively crude and imprecise, with only a few variables being changeable for a given process.

As a specific example of desirable properties, it is useful to provide alloy coatings on substrates. In many cases, it is beneficial that such coatings be relatively hard or strong, relatively ductile, and also relatively light per unit volume.

In other cases, it is beneficial to provide monolithic alloy pieces that are not connected to a substrate, or which have been removed from a substrate, as in the process of electroforming. In these cases, it is often beneficial that such pieces, or such electroforms, be relatively hard or strong, relatively ductile, and also relatively light per unit volume.

Steel has a characteristic strength to weight ratio, as do aluminum alloys, which are generally lighter than but not as strong as steel. Thus, it would be desirable to be able to produce an alloy that is as hard as steel, or nearly so, yet also as lightweight per unit volume as aluminum, or nearly so. Another, related desirable goal would be to produce an alloy that is harder than aluminum alloys, yet lighter, per unit volume, than steel.

The inventors hereof have determined that electrodeposition is particularly attractive because it exhibits the following advantages. Electrodeposition can be used to plate out metal on a conductive material of virtually any shape, to yield exceptional properties, such as enhanced corrosion and wear resistance. Electrodeposition can readily be scaled up into industrial scale operations because of relatively low energy requirements and electrodeposition offers more exact microstructure control since many processing variables (e.g. temperature, current density and bath composition) can be adjusted to affect some properties of the product. Electrodeposition can also be used to form coatings that are intended to remain atop a substrate, or electroformed parts that have some portions removed from the substrate onto which they were plated.

In addition to these advantages, electrodeposition also allows a wide range of metals and alloys to be fabricated by selection of an appropriate electrolyte. Many alloy systems, including copper-, iron-, cobalt-, gold-, silver-, palladium-, zinc-, chromium-, tin- and nickel-based alloys, can be electrodeposited in aqueous electrolytes, where water is used as the solvent. However, metals that exhibit far lower reduction potentials than water, such as aluminum and magnesium, cannot be electrodeposited in aqueous electrolytes with conventional methods. They can be electrodeposited in non-aqueous electrolytes, such as molten salts, toluene, ether, and ionic liquids. Typical variables that have been employed to control the structures of metals and alloys electrodeposited in non-aqueous electrolytes include current density, bath temperature and bath composition. However, with these variables, the range of microstructure that has been produced is limited. To date, no known method can produce a non-ferrous alloy that is as hard and ductile as steel, or nearly so, yet as light as aluminum, or nearly so, or, put another way, harder and more ductile than aluminum, yet lighter than steel.

Electrodeposition of nanocrystalline aluminum (Al) has been achieved from aluminum chloride based solutions by other researchers using direct current (DC), with additives, such as nicotinic acid, lanthanum chloride and benzoic acid While additives can effectively refine grain size, the range of grain sizes that can be obtained is limited; for instance, a very small amount of benzoic acid (0.02 mol/L) reduces the Al grain size to 20 nm and further increase in benzoic acid concentration does not cause further reduction in grain size. Additives can be organic, in the class known generally as grain refiners, and may also be called brighteners and levelers.

Electrodeposition of nanocrystalline Al has also been achieved by other researchers using a pulsed deposition current (on/off) without additives, but again, the range of grain sizes obtainable is narrow.

Processing temperature has also been found to affect the grain size of electrodeposited Al. However, using temperature to control grain size is less practical because of the long time and high energy consumption required to change the electrolyte temperature from one processing run to the next.

It would also be desirable to tailor mechanical, magnetic, electronic, optical or biological properties by manipulating parameters of the process that do not require changing electrolyte composition, such as by using additives that would not otherwise be necessary, or processing temperature, or other parameters that would be time or energy consuming to adjust, or energy intensive to use, or that would be difficult to monitor. By additives, it is meant generally grain refiners, brighteners and levelers, which include among other things nicotinic acid, lanthanum chloride, or benzoic acid, and organic grain refiners, brighteners and levelers.

It would also be desirable to be able to control such physical properties without necessarily understanding the relationship between microstructural or internal morphological characteristics such as grain size, phase domain size, phase composition and arrangement or distribution, and the physical and/or mechanical properties mentioned above. Similarly, it would be desirable to tailor surface morphology, or surface properties, such as optical luster, wettability by various liquids, coefficient of friction and corrosion resistance, by manipulating similarly convenient parameters, and further, without necessarily understanding the relationship between surface morphology and the surface properties mentioned above.

It would also be desirable to be able to create alloys, having a wide range of grain size, for instance from about 15 nm to about 2500 nm, and also to effectively control the grain size within this range. It would also be of great benefit to be able to use one single electrolytic composition, to sequentially electrodeposit alloys of different microstructures and surface morphologies. Finally, it would be of tremendous benefit to be able to provide a graded microstructure where one or all of the following are controlled through deposit thickness: grain size, chemical composition; phase composition; phase domain size; and phase arrangement or distribution.

SUMMARY

A more detailed partial summary is provided below, preceding the claims. A novel technology disclosed herein is the use of a different variable to control the structures of metals and alloys electrodeposited in non-aqueous electrolytes: the shape of the applied power waveform, typically the current waveform. With the use of waveforms containing different types of pulses, namely, cathodic, "off-time" and anodic pulses, the internal microstructure, such as grain size, phase composition, phase domain size, phase arrangement or distribution and surface morphologies of the as-deposited alloys can be tailored. Additionally, these alloys exhibit superior macroscopic mechanical properties, such as strength, hardness (which is generally proportional to strength), ductility and density. In fact, waveform shape methods have been used to produce aluminum alloys that are comparably hard (about 5 GPa and as ductile (about 13% elongation at fracture) as steel yet nearly as light as aluminum; or, stated differently, harder than aluminum alloys, yet lighter than steel, at a similar ductility. As one example, Al—Mn alloys have been made with such strength to weight ratios. Additional properties can be controlled, using the shape of the current waveform.

Further, all of the other goals just mentioned can be achieved, generally using waveform shape and a non-aqueous electrolyte, without organic grain refining additives and at a substantially constant temperature.

BRIEF DESCRIPTION OF THE FIGURES OF THE DRAWING

These and the several objects of inventions hereof will be best understood with reference to the figures of the drawing, of which.

DETAILED DESCRIPTION

The essential components of an electrodeposition setup include a power supply or rectifier, which is connected to two electrodes (an anode and a cathode) that are immersed in an electrolyte. During galvanostatic electrodeposition, the power supply controls the current that flows between the anode and cathode, while during potentiostatic electrodeposition, the power supply controls the voltage applied across the two electrodes. During both types of electrodeposition, the metal ions in the electrolytic solution are attracted to the cathode, where they are reduced into metal atoms and deposited on the cathode surface. Because galvanostatic electrodeposition is more practical and widely used, the following discussion will focus on galvanostatic electrodeposition. But, the general concepts can also be applied to potentiostatic electrodeposition.

Figure 1:
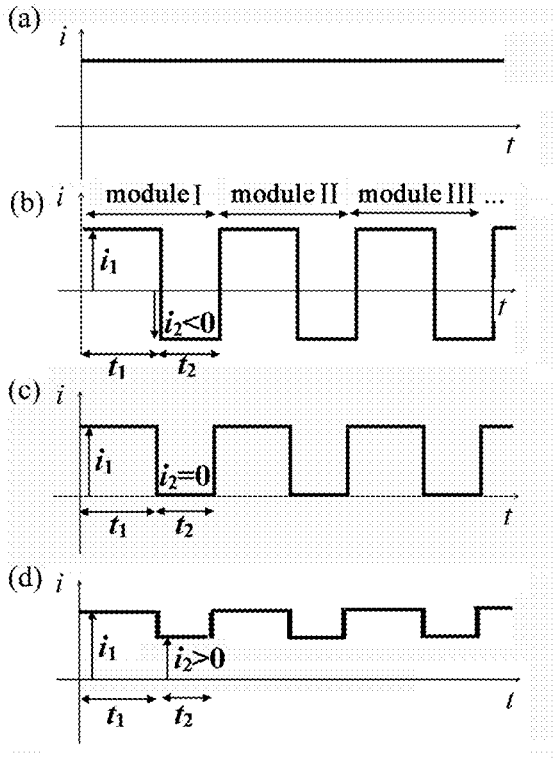
FIG. 1 is a schematic diagram showing four types of electrodeposition current waveforms, where cathodic current is defined as positive: (a) constant current density; (b) a module of one cathodic pulse, and one anodic pulse; (c) a module of one cathodic pulse and one "off-time" pulse; (d) a module of two cathodic pulses.

During conventional galvanostatic electrodeposition, the power supply applies a constant current across the electrodes throughout the duration of the electrodeposition process, as shown in FIG. 1(*a*). Herein, cathodic current (i.e. current that flows in such a direction as to reduce metal ions into atoms on the cathode surface) is defined as positive. With advances in technology, power supplies can now apply current waveforms that comprise modules, such as shown in FIGS. 1(*b*)-(*d*). Each module can, in turn, contain segments or pulses; each pulse has a defined pulse current density (e.g "$i_1$") and pulse duration (e.g. "$t_1$"). Note that even though FIGS. 1(*b*)-(*d*) illustrate waveforms that each contain only one unique module that repeats itself cyclically throughout the duration of the electrodeposition process, in some applications, each module may be different from the next. Also, even though each of the modules shown in FIGS. 1(*b*)-(*d*) comprises only two pulses, in reality, one single module can contain as many pulses as the user desires, or the power supply allows. The present discussion employs waveforms that contain only one unique and repetitive module; and each module comprises two pulses, such as those shown in FIG. 1. However, the inventions disclosed herein are not so limited, as discussed above.

In FIG. 1, waveform (b) contains one cathodic pulse ($i_1$>0) and one anodic pulse ($i_2$<0). The module in waveform (c) contains one cathodic pulse ($i_1$>0) and one "off-time" pulse ($i_2$=0); during the "off-time" pulse, no current flows across the electrodes. The module in waveform (d) is characterized by a module that contains two cathodic pulses, since $i_1$>0 and $i_2$>0. During the anodic pulse shown in (b), atoms on the cathode surface can be oxidized into metal ions, and dissolve back into the electrolyte.

The waveforms illustrated in FIG. 1 have been used to electrodeposit metals and alloys in aqueous electrolytes. In recent years, waveforms containing combinations of different types of pulses (i.e. cathodic, anodic and off-time), such as the waveforms shown in FIG. 1(*b*)-(*d*), have been gaining much attention because off-time pulses have been found to reduce internal stress in the deposits, and anodic pulses have been found to significantly affect grain size, and improve surface appearance and internal stress in the deposits. In the case of single phase alloys, the anodic pulse can preferentially removes the element with the highest oxidation potential, thus allowing control over the alloy composition. For multiphase alloy systems, the situation is more complicated—the extent to which each phase is removed during the anodic pulse depends not only on the relative electronegativity of each phase, but also on the arrangement and distribution of various phases.

The use of waveforms containing different types of pulses to control the structures of metals or alloys electrodeposited in non-aqueous media has been reduced to practice by the present inventors for the particular case of a binary alloy of aluminum-manganese (Al—Mn). In general, pulses have been used having at least two different magnitudes. For instance, cathodic pulses have been used at two different positive current levels. In some cases, the pulses also have different algebraic signs, such as a cathodic pulse followed by an anodic pulse, or a cathodic pulse followed by an off-time pulse (zero sign pulse). All such pulsing regimes have been used and have provided advantages over known techniques. In general, each pulsing regime can be characterized by a pulse that has a cathodic current with an amplitude $i_1$, that is positive, applied over a time $t_1$, and a second pulse having a current of an amplitude $i_2$, that is applied over time $t_2$, where both $t_1$ and $t_2$ are greater than about 0.1 ms, and less than about 1 s in duration, and further where the ratio $i_2/i_1$ is less than about 0.99, and greater than about −10.

It has been discovered that, using a waveform containing different types of pulses, control may be achieved over different aspects of the alloy deposits. In some cases, it has been found that direct control can be achieved, because the target property, such as ductility, bears a direct relationship to a pulsing parameter, such as the amplitude and/or duration of a pulse. In other cases, control can be achieved because it has been discovered that the target property, such as the sizes and volume fractions of the constituent phases bear a direct, gradual and continuous relationship to another variable, such as an element content (e.g., Mn) in the deposit, when a pulsed regime is used, in contrast to a non-gradual or discontinuous relationship, with abrupt transitions, when a direct current, or non-pulsed regime is used. Thus, by using the pulsed regime, and selecting the other parameter based on the continuous relationship, control over the target property, such as the size and volume fraction of a constituent phase, can be achieved.

The present inventors have conducted enough experiments to confirm that different pulsing regimes also provide different results regarding such other target properties. Thus, it is also believed that for target mechanical properties other than ductility, such as hardness, and strength, and for morphological properties such as grain size and surface texture, control may be had over such properties, by identifying a relationship between the degree of the target property and a pulsing parameter, such as the ratio of $i_2/i_1$, or perhaps the ratio of the signs of $i_2/i_1$ (meaning 0, 1 or −1). This is believed to be possible, because it is highly likely that there is variation in the target property, based on the pulsing regime. For this not to be the case, it would be necessary that a direct current plating provides deposits having one value for the target property, and all pulsing regimes provide deposits having a different value for the target property. This is highly unlikely, especially given the clear results showing a relationship between ductility and pulsing regime that follow. Alloy composition has also been found to relate to a pulse duration parameter, as discussed below.

In addition to these advantages of control over the properties of the produced alloy, it has also been discovered that alloys produced using pulsed current (or voltage) have highly advantageous strength to weight ratio properties in combination with ductility. In short, the achieved ranges for combinations of hardness, tensile yield strength, ductility and density are significantly better than those of known aluminum alloys and steels. With respect to known aluminum alloys, the alloys of the present invention have a superior combination of hardness and ductility. With respect to steels, the alloys of the present invention have a much lower density but a comparable hardness and/or ductility.

Al—Mn alloys have been electrodeposited at ambient temperature (i.e. room temperature) in an ionic liquid electrolyte with a composition summarized in Table 1. The procedure used to prepare the electrolyte is described in detail following this section. In all cases, no additives, such as brighteners and levelers, mentioned above, are provided.

TABLE 1

| Composition of electrolytic bath | |
|---|---|
| Aluminum chloride, anhydrous ($AlCl_3$) | 6.7M |
| 1-ethyl-3-methylimidazolium chloride ([EmIm]Cl) | 3.3M |
| Manganese chloride, anhydrous ($MnCl_2$) | 0-0.2M |

Electropolished copper (99%) was used as the cathode and pure aluminum (99.9%) as the anode. Electrodeposition was carried out at room temperature under galvanostatic conditions. The waveforms used are shown in FIG. 1; the variables are $i_1$, $i_2$, $t_1$ and $t_2$. Initially, two types of current waveforms, namely A and B, were used to electrodeposit alloys with Mn content ranging from 0 to 16 at. %. Details of these two types of waveforms are shown in Table 2. Note that the shape of waveform A is similar to that shown in FIG. 1(*a*); it is a direct current waveform. Waveform B is similar to FIG. 1(*b*); it is a waveform containing an anodic pulse and a cathodic pulse. Thus, the A waveform has an $i_2/i_1$ ratio of 1, and the B waveform has such a ratio of −1/2.

TABLE 2

| Deposition parameters | | | | | |
|---|---|---|---|---|---|
| | Pulse current density ($mA/cm^2$) | | Pulse duration (ms) | | Temperature |
| Waveform | $i_1$ | $i_2$ | $t_1$ | $t_2$ | (° C.) |
| A | 6 | 6 | 20 | 20 | 25 |
| B | 6 | −3 | 20 | 20 | 25 |

Procedure on Electrolyte Preparation

All chemicals were handled in a glove box under a nitrogen atmosphere, with $H_2O$ and $O_2$ contents below 1 ppm. The organic salt, 1-ethyl-3-methyl-imidazolium chloride, (EMIm)Cl (>98% pure, from IoLiTec), was dried under vacuum at 60° C. for several days prior to use. Anhydrous $AlCl_3$ powder (>99.99% pure, from Aldrich) was mixed with EMImCl in a 2:1 molar ratio to prepare the deposition bath. Prior to deposition, pure Al foil (99.9%) was added to the ionic liquid, and the solution was agitated for several days, in order to remove oxide impurities and residual hydrogen chloride. After filtering through a 1.0 μm pore size syringe filter, a faint yellowish liquid was obtained. The nominal manganese chloride ($MnCl_2$) concentrations were varied by controlled addition of anhydrous $MnCl_2$ (>98% pure, from Aldrich) to the ionic liquid.

Alloy sheets approximately 20 μm in thickness were electrodeposited. Chemical compositions of the alloys were quantified via energy dispersive x-ray analysis (EDX) in a scanning electron microscope (SEM), where the surface morphologies of the alloys were also examined. Phase compositions of the alloys were studied using X-ray diffraction (XRD). Grain morphology and phase distribution were examined in the transmission electron microscope (TEM). Standard Vickers microindentation tests were carried out on selected alloys produced by waveform B using a load of 10 grams and a holding time of 15 seconds. The indentation depth was in all cases significantly less than 1/10 the film thickness, ensuring a clean bulk measurement. To assess the ductility of the alloys in a state of uniaxial tension, the guided-bend test was carried out, as detailed in ASTM E290-97a (2004). The thickness, t, of tested samples (i.e. film and copper substrate together) was measured using a micrometer and ranged from 0.220±0.02 mm to 0.470±0.02 mm; and the radii of the end of the mandrel, r, ranged from 0.127 to 1.397 mm. After the guided bend test, the convex bent surfaces of the films were examined for cracks and fissures using the scanning electron microscope (SEM).

For each bent sample (i.e. film and copper substrate together), the thickness of the film was less than 10% that of the substrate. Thus, to a good approximation, the film lies on the outer fiber of the bent specimen, and experiences a state of uniaxial tension. The top half of the bent sample is in a state of tension, while the bottom half is in compression, and the neutral plane is approximately midway between the convex and concave surfaces. The true tensile strain on the convex surface is approximated as $\varepsilon=\ln(l/l_0)$, where l is the convex arc length and $l_0$ is the arc length of the neutral plane. Geometric considerations give $$\varepsilon = \ln\left(\frac{r/t+1}{r/t+1/2}\right).$$

Thus, r/t ratios of ~0.6, 3 and 5.5 correspond to strain values of ~37%, 13% and 8% respectively.

Alloy Composition

Figure 2:
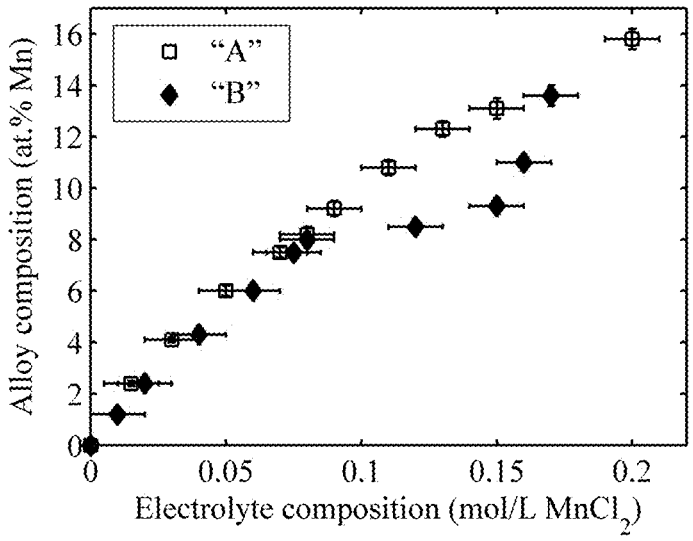
FIG. 2 is a plot showing graphically, the effects of varying electrolytic composition on the Mn content of the alloys electrodeposited using A (direct current) and B (cathodic and anodic) waveforms.

FIG. 2 summarizes the effects of electrolyte composition and current waveform on the Mn content of the as-deposited alloys. For alloys electrodeposited in electrolytes that contain between ~0.1 and 0.16 mol/L of $MnCl_2$, alloys produced by waveform B have lower Mn content, as compared to alloys deposited using waveform A. Thus, FIG. 2 provides evidence that an anodic pulse preferentially removes Mn from the as-deposited alloy under the deposition parameters summarized in Table 2. Herein, instead of referring to the composition of the deposition bath, the samples will be labeled with the name of the waveform used (i.e. A, B, C, etc.), as well as their alloy composition. (From the alloy composition, the bath composition can be determined by referring to FIG. 2.)

Surface Morphology

SEM images depicting the surface morphologies of the as-deposited alloys were prepared and analyzed. The surface morphologies of the A alloys show an abrupt transition from highly facetted structures between 0.0 at. % and 7.5 at. %, to rounded nodules between 8.2 at. % and 13.6 at. %. The surface morphologies of the B alloys, on the other hand, show a gradual transition from highly facetted structures between 0.0 at. % and 4.3 at. %, to less angular and smaller structures between 6.1 at. % and 7.5 at. %; and then to a smooth and almost featureless surface at 8.0 at. %, before rounded nodules start to appear between 11 at. % and 13.6 at. %.

Figure 3:
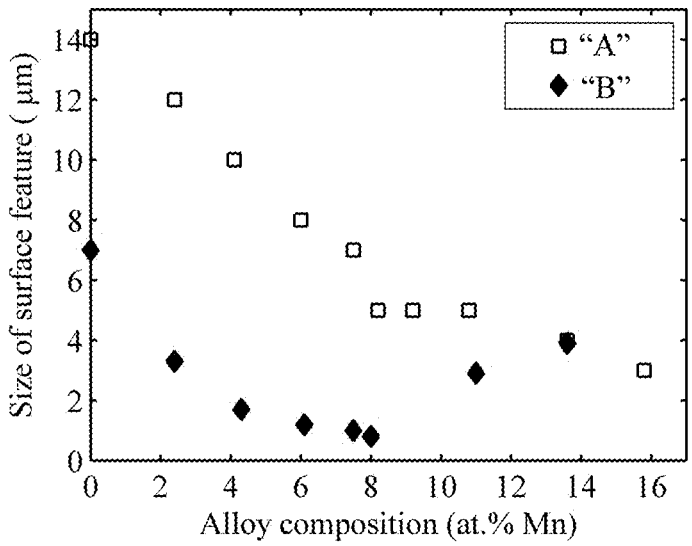
FIG. 3 shows, graphically, average sizes of surface features, as determined from SEM images using the linear intercept method, for alloys deposited using A and B waveforms.

A linear intercept method was used to determine the average characteristic size of the surface features for both A (direct current) and B (cathodic/anodic) alloys, and FIG. 3 summarizes the results graphically. Across the whole composition range examined, the surface feature size of the B alloys is smaller than that of the A alloys. Whereas the surface feature size continually decreases as Mn content increases for the A alloys, that of the B alloys exhibit a local minimum at ~8 at. %.

Optically, the B alloys appear smoother, as compared to A alloys with similar Mn contents. Additionally, the B alloys show an interesting transition in appearance: as the Mn content increases from 0 to 7.5 at. %, the dull grey appearance becomes white-grey. Alloys with more than 8.0 at. % Mn show a bright-silver appearance; and the 8.0 at. % Mn alloy exhibits the highest luster.

Phase Composition

Figure 4:
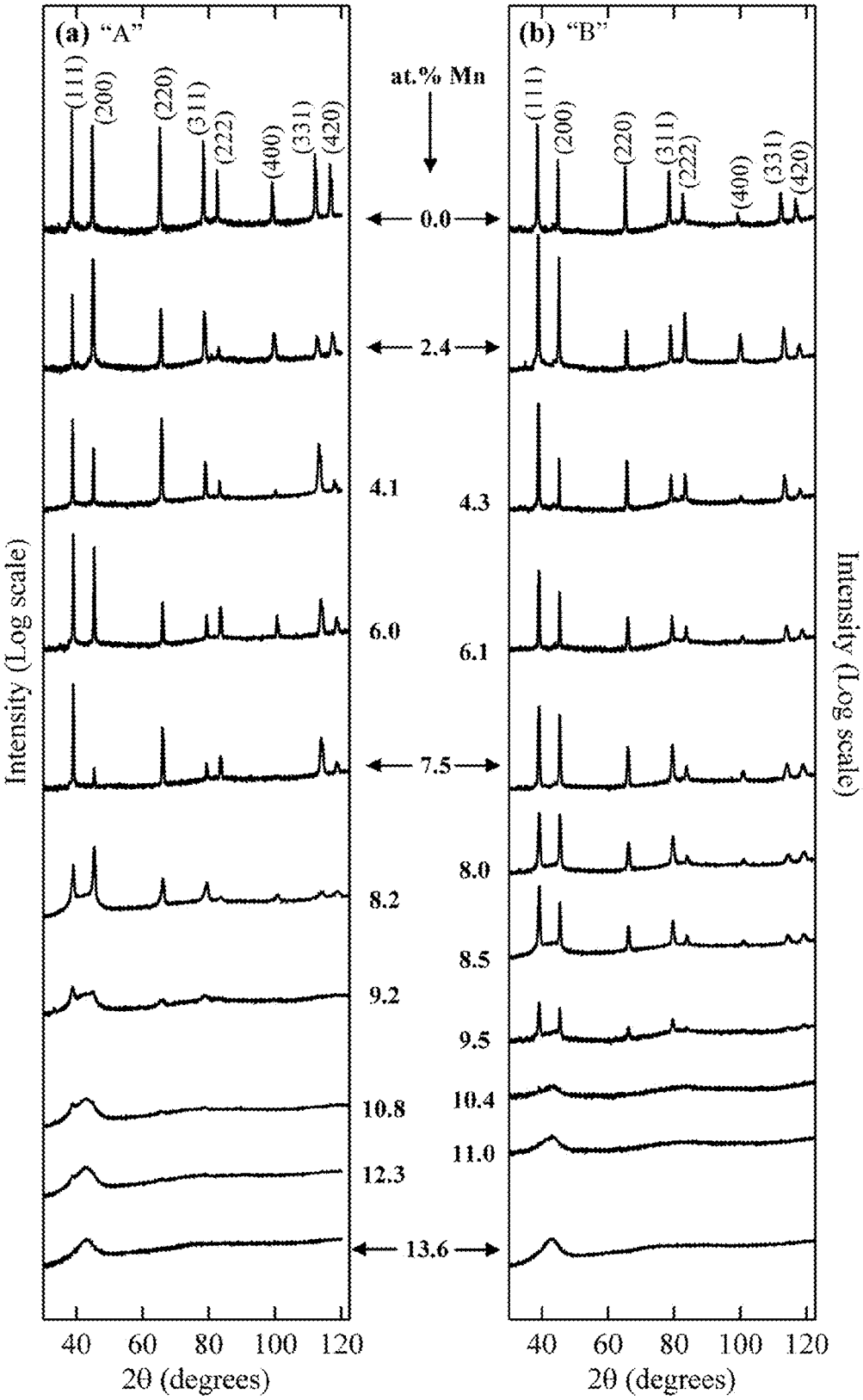
FIGS. 4A-4B show, schematically, X-ray diffractograms of alloys deposited using: (A) waveform A; and (B) waveform B; with compositions of alloys shown between both panels.

FIG. 4 shows X-ray diffractograms of the (a) A and (b) B alloys. Both A and B alloys exhibit similar trends in phase compositions: at low Mn content, the alloys exhibit a FCC Al(Mn) solid solution phase; at intermediate Mn content, an amorphous phase, which exhibits a broad halo in the diffraction pattern at ~42° 2θ, co-exists with the FCC phase; at high Mn content, the alloys contain an amorphous phase. Additionally, both A and B alloys transition from a single FCC phase to a duplex structure at about the same composition of ~8 at. % Mn.

Figure 5:
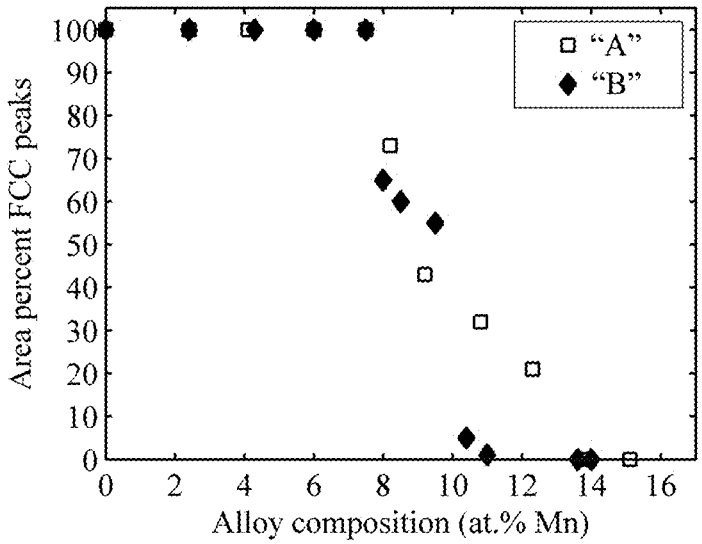
FIG. 5 shows, graphically percent contribution of FCC peaks to the total integrated intensities observed in X-ray diffractograms, as shown in FIGS. 4A and 4B, for alloys deposited using waveforms A and B.
Figure 6A:
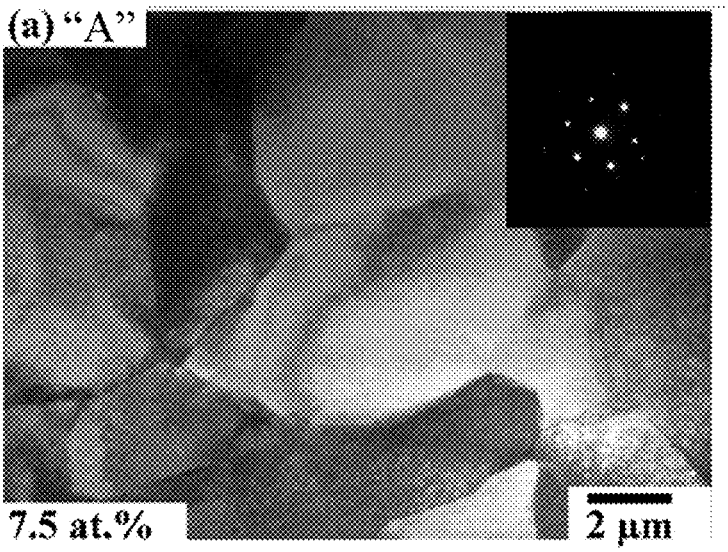
FIGS. 6A-6F show bright-field transmission electron microscopy (TEM) digital images and inset electron diffraction patterns of alloys electrodeposited using waveform A, with global Mn content of each alloy shown in the lower-left corner of each panel.
Figure 6B:
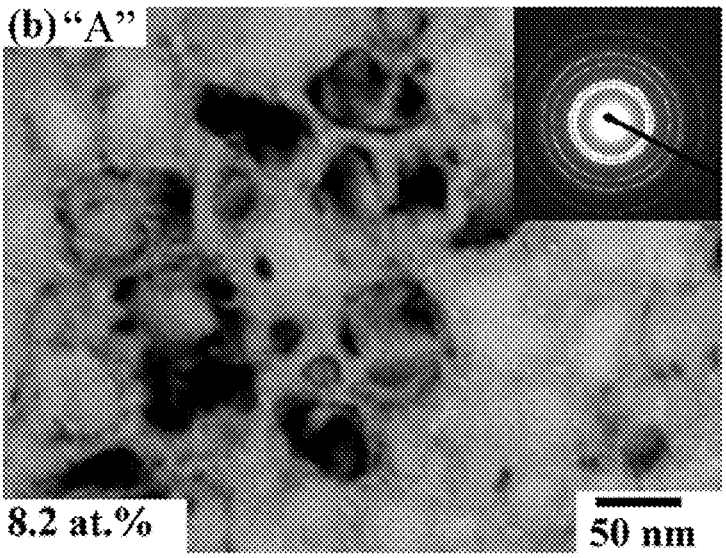
Figure 6C:
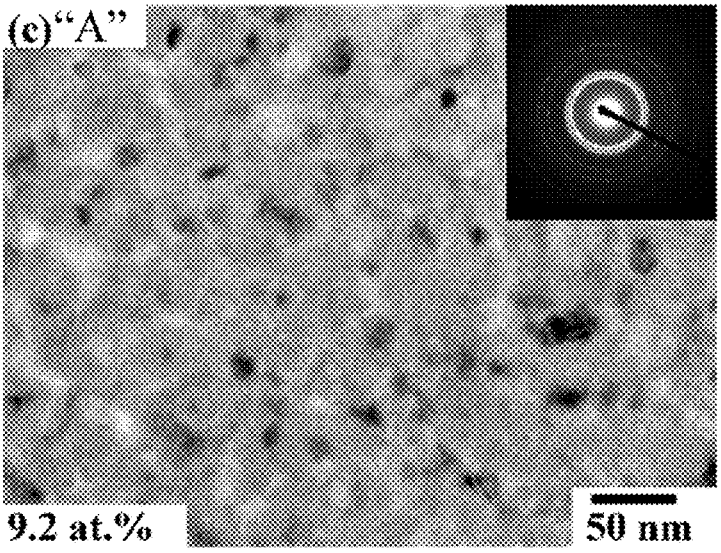
Figure 6D:
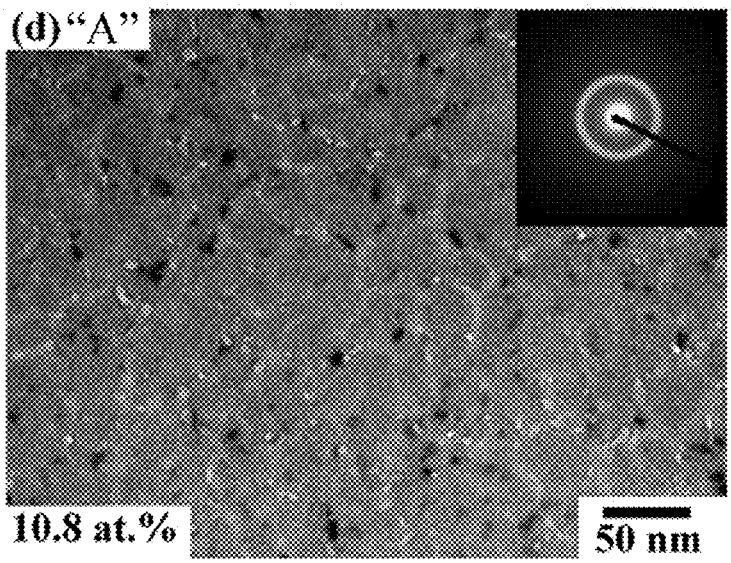
Figure 6E:
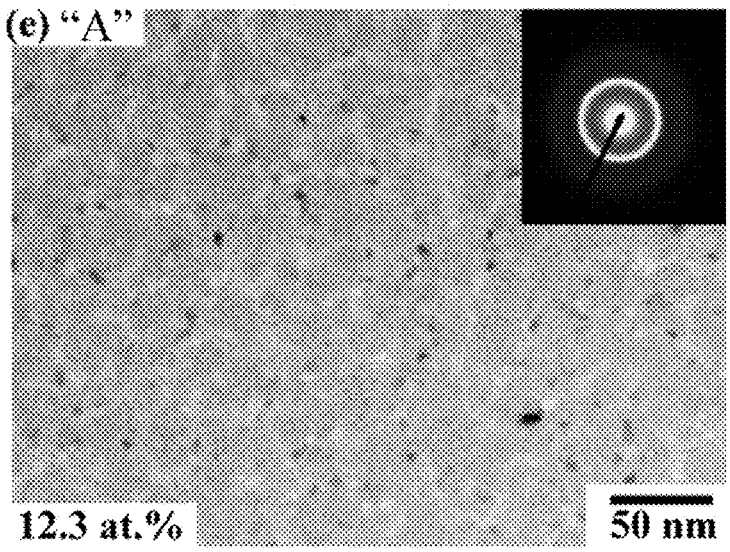
Figure 6F:
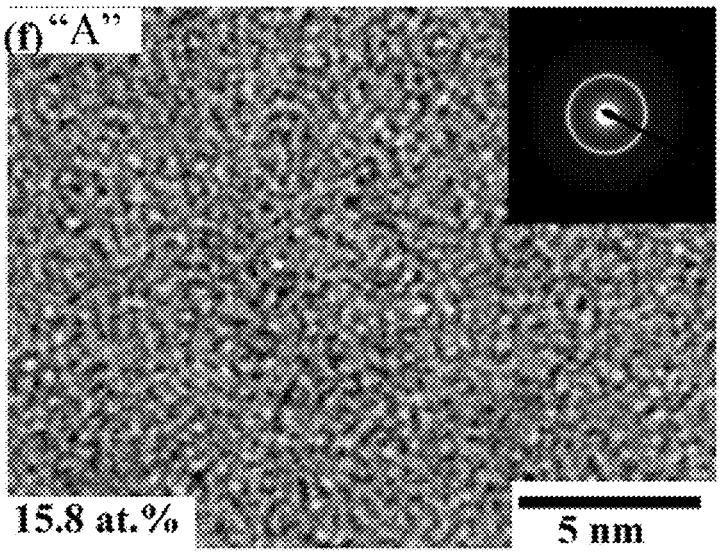
Figure 7A:
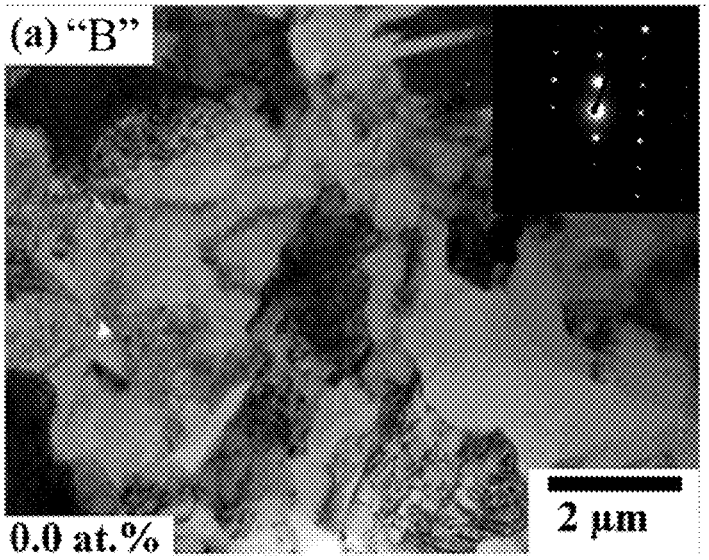
FIGS. 7A-7I show bright-field TEM digital images and inset electron diffraction patterns of alloys electrodeposited using waveform B, with global Mn content of each alloy shown in the lower-left corner of each panel.
Figure 7B:
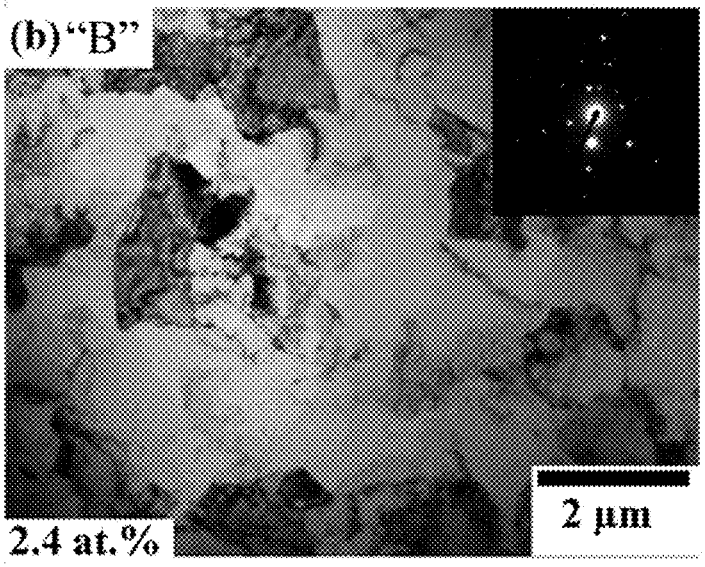
Figure 7C:
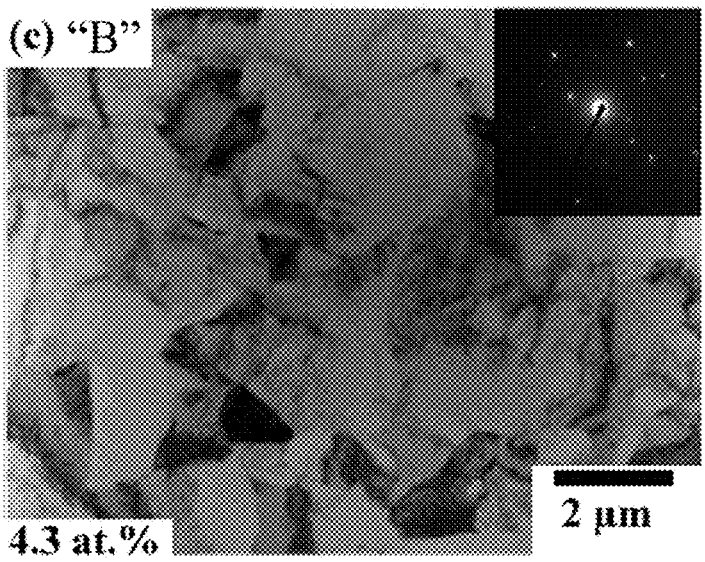
Figure 7D:
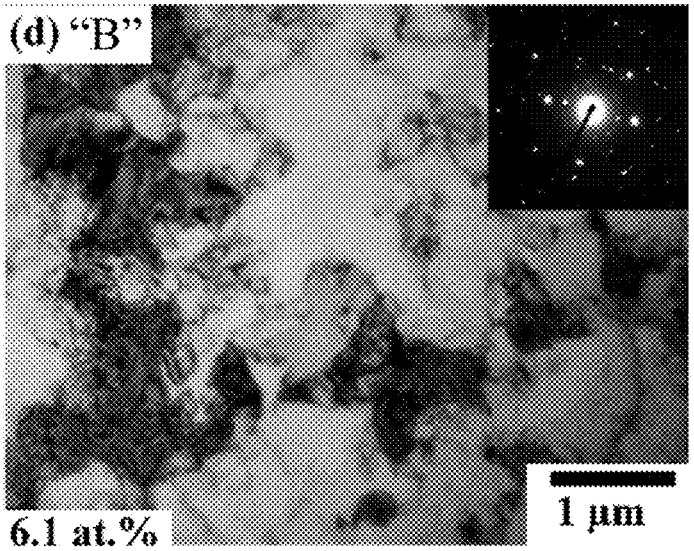
Figure 7E:
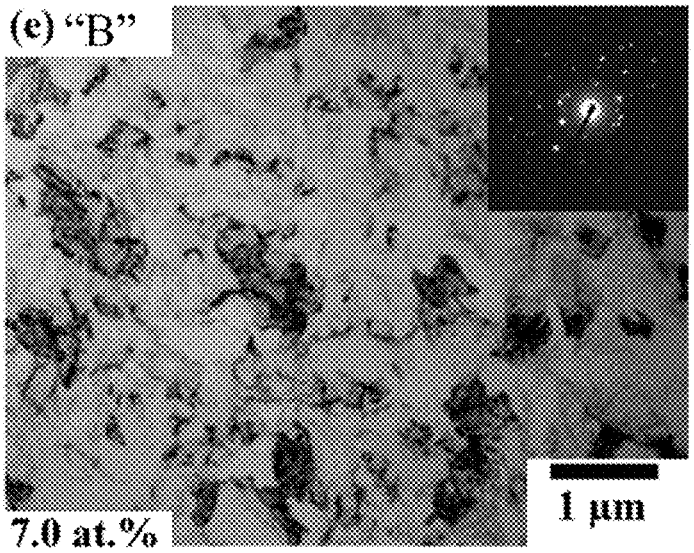
Figure 7F:
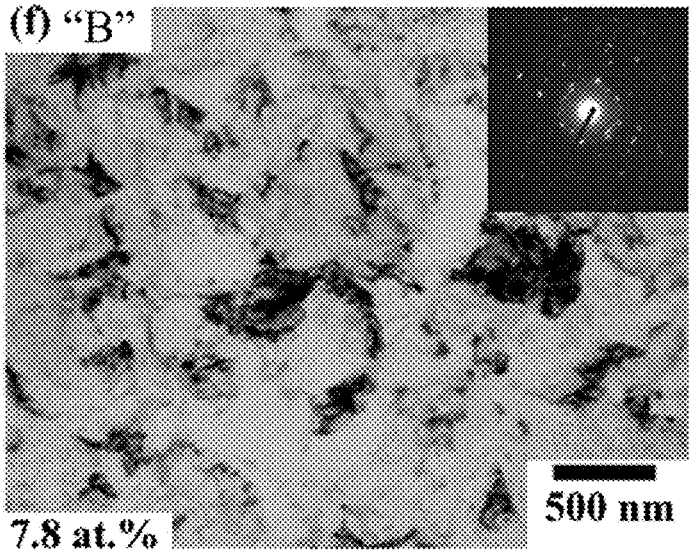
Figure 7G:
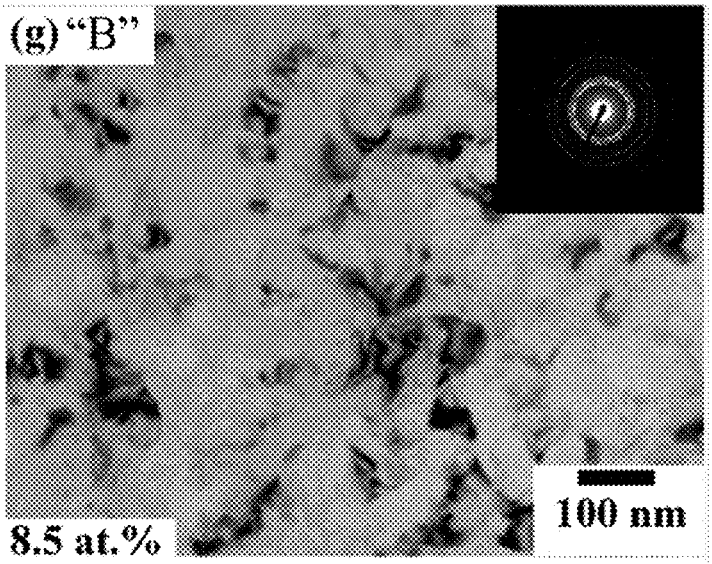
Figure 7H:
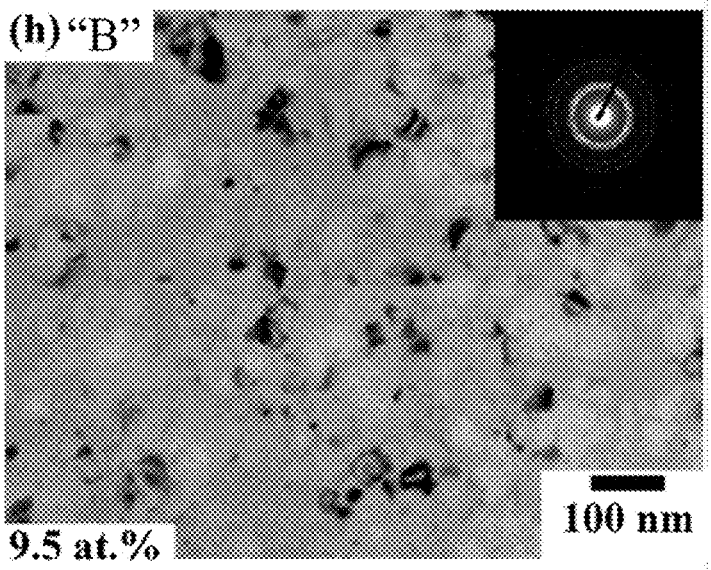
Figure 7I:
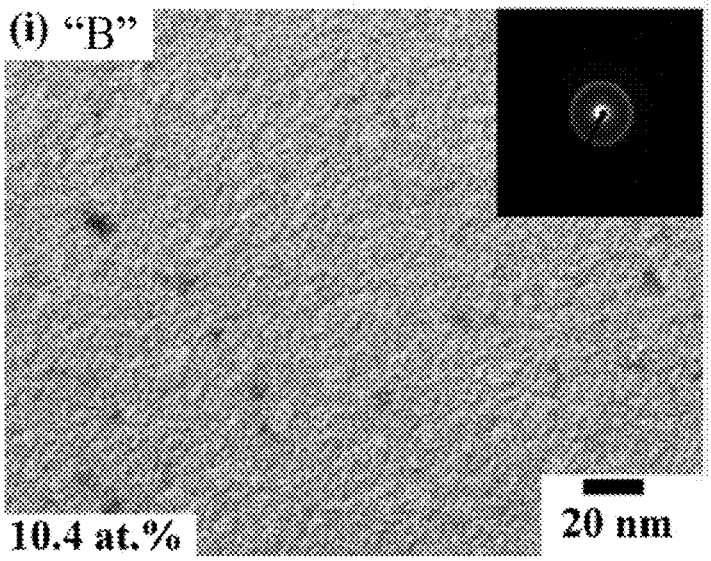

FIG. 5 shows graphically the percent contribution of FCC peaks to the total integrated intensities observed in the XRD patterns for the as-deposited alloys. The composition range over which the alloys exhibit a two-phase structure is wider for the A alloys (between 8.2 and 12.3 at. % Mn), and that for the B alloys is narrower (between 8.0 and 10.4 at. % Mn). Additionally, closer inspection of FIGS. 4(A) and 4(B) suggests that for the two-phase alloys, the FCC peaks for the A alloys are broader than those for the B alloys with similar Mn content. Therefore, the XRD results suggest that pulsing with anodic current alters the phase composition of the alloys, and possibly the FCC phase domain size and phase distribution as well. These two characteristics will be further discussed in the following section.

Characteristic Microstructural Length Scale and Phase Distribution

FIG. 6 shows transmission electron microscopy (TEM) digital images of the A (direct current) samples. The characteristic microstructural length scales for these samples are the average FCC grain size or the average FCC phase domain. The characteristic microstructural length scale of the A samples shows a sharp transition from ~4 μm (FIG. 6(*a*)) to ~40 nm (FIG. 6(*b*)) as the Mn content increases slightly from 7.5 at. % to 8.2 at. %. Additionally, the two phase alloys (FIGS. 6(*b*)-(*e*)) consist of convex regions that are about 20-40 nm in diameter and surrounded by network structures. At 8.2 at. %, the FCC phase occupies the convex regions; whereas the amorphous phase occupies the network. Between 9.2 and 12.3 at. % Mn, the converse is observed: the amorphous phase populates the convex regions, while the FCC phase occupies the network. Thus, FIG. 6 shows that phase separation in the two phase alloys results in a convex region-network structure.

FIG. 7 shows the TEM digital images of the B (cathodic/anodic) alloys. The characteristic microstructural length scale decreases gradually from ~2 μm to 15 nm as the Mn content increases from 0 to 10.4 at. %. Additionally, the two-phase alloys (FIGS. 7(*g*)-(*i*)) do not exhibit the characteristic convex region-network structure that was observed in the A alloys. Instead, the FCC grains appear uniformly dispersed and the amorphous phase is assumed to be distributed in the intergranular regions. In general, it appears that waveform B results in a more homogeneous distribution of different phases.

Figure 8:
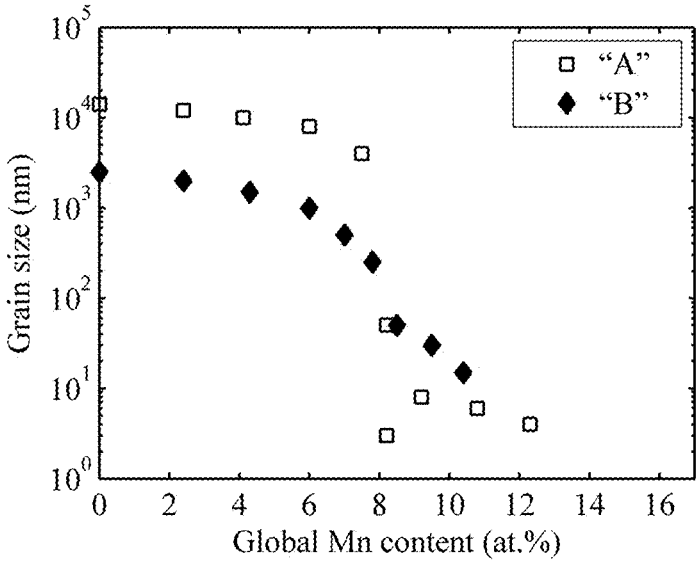
FIG. 8 shows, graphically, characteristic microstructural length scale, as determined from TEM digital images, for alloys deposited using A and B waveforms.

FIG. 8 shows, graphically, the characteristic microstructural length scale of the A and B alloys as a function of Mn content. Whereas the A alloys show an abrupt transition from micrometer-scale to nanometer-scale grains or FCC phase domains, the characteristic microstructural length scale of the B alloys gradually transitions from microns to nanometers. Thus, FIG. 8 provides evidence that application of cathodic and anodic pulses allows tailoring the FCC grain or phase domain size of both micro-crystalline and nano-crystalline Al—Mn alloys. Cathodic/anodic pulsing allows a more continuous range of characteristic microstructural length scales, in both the microcrystalline and nano-crystalline regime, to be synthesized. Using cathodic/anodic pulsing, a desired FCC phase domain or grain size can be achieved by choosing the Mn content that corresponds with that grain size. This cannot be done using direct current, because the transition between different characteristic microstructural length scale regimes is too abrupt to allow tailoring. Additionally, cathodic/anodic-pulsing apparently disrupts the formation of a convex region-network structure in the two-phase alloys, resulting in a more homogeneous two-phase internal morphology.

Hardness

Figure 9:
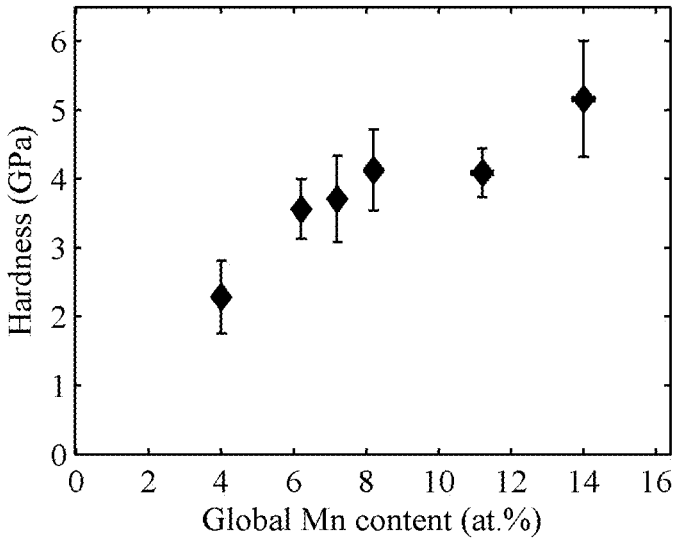
FIG. 9 shows, graphically, hardness vs. Mn content for alloys deposited using waveform B.

FIG. 9 shows, graphically, the hardness values of the B alloys as a function of Mn content. The hardness generally increases with Mn content. This increase in hardness is believed to result from a combination of solid-solution strengthening and grain size refinement.

Ductility

Digital images of the strained surfaces of the A and B waveform alloys after the guided-bend test were taken and analyzed. Images of A and B alloys with similar Mn content were compared. The SEM images show that for all compositions, the A (direct current) alloys were more severely cracked than the B (cathodic/anodic) alloys. For the A alloys, only the pure Al did not exhibit cracks. For the B alloys, composition up to 6.1 at. % Mn did not show cracks. Additionally, while all the A alloys with Mn content above 8.2 at. % exhibit cracks that propagate through the entire width of the sample, only the 13.6 at. % Mn B alloy shows cracks that propagate through the sample width. Comparing the 13.6 at. % Mn alloys produced by A and B waveforms, shows that the number density of cracks in the B alloy is lower than that of the A alloy. Table 3 summarizes the present observations, and provides evidence that the B alloys are more ductile than the A alloys across the entire composition range examined.

TABLE 3

Dimensions of cracks observed on strained surface of alloys after guided bend test, where r/t~0.6.

| A | | | B | | |
|---|---|---|---|---|---|
| Mn content (at. %) | Crack length (μm) | Crack width (μm) | Mn content (at. %) | Crack length (μm) | Crack width (μm) |
| 0.0 | x | x | 0.0 | x | x |
| 2.4 | 100 | 2 | 2.4 | x | x |
| 4.1 | 670 | 25 | 4.3 | x | x |
| 6.0 | 430 | 28 | 6.1 | x | x |
| 8.2 | Across whole sample | 40 | 8.0 | 120 | 13 |
| 10.8 | Across whole sample | 40 | 11.0 | 200 | 2 |
| 13.6 | Across whole sample | 40 | 13.6 | Across whole sample | 40 |

Results for alloys deposited with A waveform are shown on the left of table; results for B waveform alloys are shown on the right.
"x" represents no cracks observed in the SEM.

Additional guided bend tests were also carried out on the 8.0 at. % Mn and 13.6 at. % Mn alloys, produced by the B waveform. SEM digital images of these bent samples were created and compared. The samples of the B waveform 8.0 at. % Mn were bent at r/t ratios of 0.6 and 3. While cracks were observed throughout the sample that was bent at r/t~0.6 only a small crack was found on the sample that was bent at r/t~3. Thus, these observations suggest that the strain at fracture of the B waveform 8.0 at. % alloy is probably close to 13%.

Samples of the B waveform 13.6 at. % Mn were bent at r/t ratios of 0.6 and 5.5 and SEM digital images were taken of those samples, and analyzed. While multiple cracks propagated throughout the width of the sample that was bent at r/t~0.6, only one crack propagated about ¼ across the sample width of the sample that was bent at r/t~5.5. Thus, these observations suggest that the strain at fracture of the B waveform 8.0 at. % alloy is probably close to 8%.

The previous portions discuss in detail the effects of applying one particular type of pulsed waveform, which contains cathodic and anodic pulses, on the microstructure and properties of the Al—Mn system, as compared to a direct current waveform. In the following, results are presented on Al—Mn alloys that were electrodeposited using different pulse parameters. Also shown are results on Al—Mn—Ti alloys that were electrodeposited in a different electrolytic solution at a different temperature.

To investigate the effects of varying the current density $i_2$ on alloy composition, waveforms A, C, D, E, B and F were used to electrodeposit Al—Mn alloys from electrolytic baths containing the same amounts of $MnCl_2$. Table 4 summarizes the pulse parameters of these six waveforms.

TABLE 4

Pulse parameters of waveforms used to investigate the effects of $i_2$.

| | Pulse current density ($mA/cm^2$) | | Pulse duration (ms) | | Temperature |
|---|---|---|---|---|---|
| Waveform | $i_1$ | $i_2$ | $t_1$ | $t_2$ | (° C.) |
| A | 6 | 6 | 20 | 20 | 25 |
| C | 6 | 3 | 20 | 20 | 25 |
| D | 6 | 1 | 20 | 20 | 25 |
| E | 6 | 0 | 20 | 20 | 25 |

TABLE 4-continued

Pulse parameters of waveforms used to investigate the effects of $i_2$.

| | Pulse current density ($mA/cm^2$) | | Pulse duration (ms) | | Temperature |
|---|---|---|---|---|---|
| Waveform | $i_1$ | $i_2$ | $t_1$ | $t_2$ | (° C.) |
| B | 6 | −3 | 20 | 20 | 25 |
| F | 6 | −3.75 | 20 | 20 | 25 |

Figure 10:
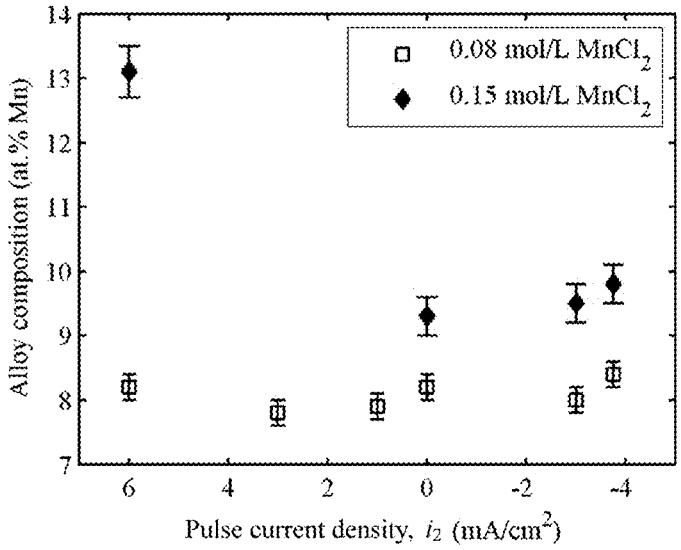
FIG. 10 shows, graphically, effects of $i_2$ on the Mn content of alloys electrodeposited in electrolytes containing 0.08 and 0.15 mol/L $MnCl_2$.

Thus, the C waveform has an $i_2/i_1$ ratio of 1/2, and the D waveform has such a ratio of 1/6, the E waveform has such a ratio of 0, and the F waveform has such a ratio of −3.75/6 (=−0.625). FIG. 10 shows the effects of $i_2$ on alloy composition for alloys that were electrodeposited in electrolytic solutions containing 0.08 mol/L and 0.15 mol/L $MnCl_2$. The results show that for alloys deposited in solutions containing 0.08 mol/L $MnCl_2$, $i_2$ has no effect on the alloy composition (to within experimental uncertainties in composition measurements). However, for alloys deposited in solutions containing 0.15 mol/L $MnCl_2$, for $i_2$=6 $mA/cm^2$ (waveform A) the alloy content is 13.1 at. %, whereas for $i_2$=0 $mA/cm^2$ (waveform E), the alloy Mn content is less-9.3 at. %.

Guided bend tests were carried out on alloys containing about 8 at. % Mn produced by the six waveforms shown in Table 4; SEM images of the strained surfaces were taken and analyzed. Some alloys were bent to an r/t ratio of ~0.6; Others were bent to an r/t ratio of ~3. The current density $i_2$ was decreased from positive to negative over the range of alloys tested. To further compare alloys A, C and D, additional guided bend tests were carried out at r/t ratios of ~5.5 and SEM images of the results were taken and analyzed. Table 5 summarizes the observations.

TABLE 5

Dimensions of cracks observed on strained surfaces of alloys containing ~8 at. % Mn after guided bend test, where r/t ~0.6, ~3.0 and ~5.5.

| r/t ratio | Waveform | $i_2$ (mA/cm$^2$) | Crack length (μm) | Crack width (μm) |
|---|---|---|---|---|
| ~0.6 | A | 6 | Across whole sample | 40-150 |
| | C | 3 | Across whole sample | 50 |
| | D | 1 | 150 | 25 |
| | E | 0 | 40 | 10 |
| | B | −3 | 120 | 13 |
| | F | −3.75 | 300 | 20 |
| ~3.0 | A | 6 | Across whole sample | 100 |
| | C | 3 | Across whole sample | 40 |
| | D | 1 | 50-300 | 20 |
| | E | 0 | x | x |
| | B | −3 | 30 | 5 |
| | F | −3.75 | 200 | 5 |
| ~5.5 | A | 6 | Across whole sample | 10 |
| | C | 3 | 1500 | 10 |
| | D | 1 | 1500 | 10 |

Analyses of the SEM images and Table 5 show that decreasing the magnitude of $i_2$ causes the ductility of the alloys to increase; whereas the A alloys cracked across the sample widths, those produced by most other waveforms did not. For positive values of $i_2$ (i.e. waveforms A, C and D), decreasing the magnitude of the positive pulse current causes the ductility to increase. The A and C alloys cracked across the sample width when bent to r/t ratios of ~0.6 and 3, cracks did not propagate through the widths of the D alloys. The A alloy exhibited cracks that propagated across the sample width when bent to r/t ratio of ~5.5; on the other hand, cracks did not propagate through the sample widths of the C and D alloys. Interestingly, for the E, B and F alloys, as $i_2$ becomes more negative, the ductility of the alloy decreases. When the alloys were bent to an r/t ratio of 0.6, alloys that were produced by waveform F, where $i_2$=−3.75 mA/cm$^2$, exhibited cracks that were relatively long and wide (~300 μm by ~20 μm); whereas alloys produced by waveform E, where $i_2$=0 mA/cm$^2$, showed the smallest cracks (~40 μm by ~10 μm). When the alloys were bent to an r/t ratio of 3, the "F" alloy exhibited a single crack, whose dimensions are larger than that observed on the B alloy. The E alloy did not exhibit cracks when bent to an r/t ratio of ~3. Thus, there is a ductility maximum resulting from using a waveform with $i_2$ somewhere between +1 and −3, probably near to zero.

Pulse Duration $t_2$

To investigate the effects of varying the pulse duration $t_2$ on alloy composition, cathodic/anodic waveforms G, H and B were used to electrodeposit alloys from electrolytic baths containing the same amounts of $MnCl_2$. Table 6 summarizes the pulse parameters for these four waveforms. This table lists not only $t_1$ and $t_2$, but further compares the waveforms on the basis of the time over which negative current is applied, $t_n$; this is done because waveform A does not involve pulses of negative current (and thus its value of $t_n$ is zero) whereas the other waveforms all involve negative currents (at −3 mA/cm$^2$).

TABLE 6

Pulse parameters of waveforms used to investigate the effects of $t_2$.

| | Pulse current density (mA/cm$^2$) | | Pulse duration (ms) | | | Temperature |
|---|---|---|---|---|---|---|
| Waveform | $i_1$ | $i_2$ | $t_1$ | $t_2$ | $t_n$ | (° C.) |
| A | 6 | 6 | 20 | 20 | 0 | 25 |
| G | 6 | −3 | 20 | 5 | 5 | 25 |
| H | 6 | −3 | 20 | 10 | 10 | 25 |
| B | 6 | −3 | 20 | 20 | 20 | 25 |

Figure 11:
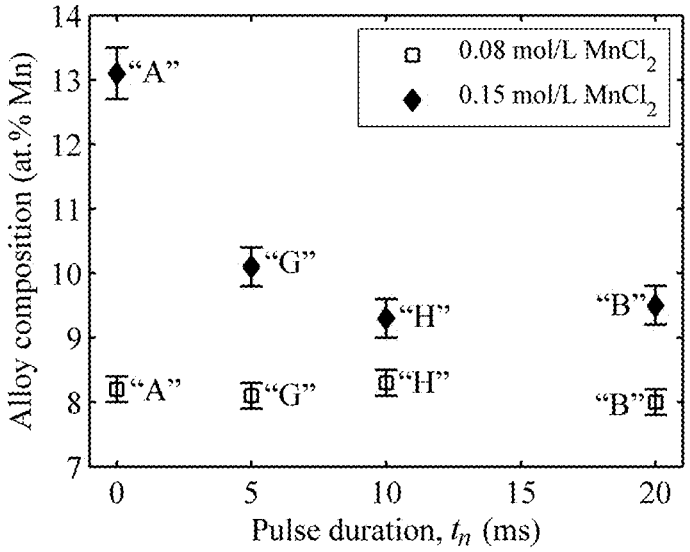
FIG. 11 shows, graphically, effects of $t_n$ on the Mn content of alloys electrodeposited in electrolytes containing 0.08 and 0.15 mol/L $MnCl_2$, where $i_1$=6 mA/cm$^2$ and $i_2$=−3 mA/cm$^2$.

FIG. 11 shows the effects of $t_n$ on alloy composition for alloys that were electrodeposited in electrolytic solutions containing 0.08 mol/L and 0.15 mol/L $MnCl_2$. The results show that for alloys deposited in solutions containing 0.08 mol/L $MnCl_2$, $t_n$ has no effect on the alloy composition (to within experimental uncertainties in composition measurements). However, for alloys deposited in solutions containing 0.15 mol/L $MnCl_2$, as $t_n$ increases from 0 ms (waveform A) to 10 ms (waveform H), the alloy Mn content decreases from 13.1 at. % to 9.3 at. %. However, further increase in $t_n$ does not significantly change the alloy composition.

Guided bend tests were carried out on alloys containing about 8 at. % Mn produced by the A, G, H and B waveforms; Some samples were bent to an r/t ratio of ~0.6; other samples were bent to an r/t ratio of ~3. SEM images of the strained surfaces were acquired and analyzed. Table 7 summarizes the observations.

TABLE 7

Dimensions of cracks observed on strained surfaces of alloys containing ~8 at. % Mn after guided bend test, where r/t ~0.6 and r/t ~3.0.

| r/t ratio | Waveform | $t_n$ (ms) | Crack length (μm) | Crack width (μm) |
|---|---|---|---|---|
| ~0.6 | A | 0 | Across whole sample | 40-150 |
| | G | 5 | Across whole sample | 25 |
| | H | 10 | 300 | 20 |
| | B | 20 | 120 | 13 |
| ~3.0 | A | 0 | Across whole sample | 100 |
| | G | 5 | Across whole sample | 20 |
| | H | 10 | 200 | 25 |
| | B | 20 | 30 | 5 |

The SEM images and Table 7 show that for the same pulse current density $i_2$ (i.e. −3 mA/cm$^2$), increasing the pulse duration $t_n$ causes the ductility of the alloys to increase. Both the A and G alloys ($t_n$=0 and 5 ms, respectively) exhibit cracks that propagate across the sample width when bent to an r/t ratio of ~0.6 and ~3. On the other hand, the H and B alloys did not crack across the entire width of the sample when bent. As $t_n$ increases from 10 ms (waveform H) to 20 ms (waveform B), both the crack length and width decrease.

Taking this study together with that above, which demonstrated that, for an $i_2$ of constant duration, the direct current alloys were the least ductile, it can be seen that providing a cathodic pulse and then another pulse, either cathodic (waveforms C, D), anodic (waveforms B, F), or off-time (waveform E), and of different durations (waveforms G, H), provides a more ductile alloy than would direct current (waveform A).

The foregoing experiments were conducted with pulses of between 0 and 20 ms. However, it is believed that pulses may be used having a duration of between about 0.1 ms and about 1 s. Al—Mn—Ti alloys were electrodeposited using the electrolytic bath composition shown in Table 8. A silicone oil bath was used to maintain the temperature of the electrolyte at 80° C. during the electrodeposition experiments.

TABLE 8

Composition of electrolytic bath used to electrodeposit Al—Mn—Ti alloys.

| | |
|---|---|
| Aluminum chloride, anhydrous ($AlCl_3$) | 6.7M |
| 1-ethyl-3-methylimidazolium chloride ([EmIm]Cl) | 3.3M |
| Manganese chloride, anhydrous ($M^nCl_2$) | 0.08M |
| Titanium chloride, anhydrous ($TiCl_2$) | 0.04M |

Two types of waveforms were used to electrodeposit Al—Mn—Ti, namely waveform I (a direct current waveform) and waveform J, (a cathodic/anodic waveform). Table 9 summarizes the pulse parameters of these waveforms, along with the alloy compositions.

TABLE 9

Pulse parameters of waveforms used, along with the chemical compositions of the electrodeposited Al—Mn—Ti alloys.

| | Pulse current density mA/cm$^2$) | | Pulse duration (ms) | | Temperature | Alloy composition (at. %) | |
|---|---|---|---|---|---|---|---|
| Waveform | $i_1$ | $i_2$ | $t_1$ | $t_2$ | (° C.) | Mn | Ti |
| I | 6 | 6 | 20 | 20 | 80 | 7.1 ± 0.2 | 1.1 ± 0.1 |
| J | 6 | −0.5 | 20 | 20 | 80 | 5.9 ± 0.2 | 2.6 ± 0.1 |

Thus, the I waveform has an $i_2/i_1$ ratio of 1, and the B waveform has such a ratio of −1/12. Table 9 suggests that the anodic pulse decreases the Mn content of the electrodeposited alloys, but increases the Ti content. The total solute content for the I and J alloys are 8.2 and 8.5 at. %, respectively. Alloys produced by the I (DC) and J (cathodic/anodic) waveforms were bent to an r/t ratio of ~0.6. SEM images were taken of the strained surfaces of these alloys. Table 10 summarizes observations.

TABLE 10

Dimensions of cracks observed on strained surfaces of Al—Mn—Ti alloys containing ~8 at. % solute after guided bend test, where r/t ~0.6.

| r/t ratio | Waveform | Crack length (μm) | Crack width (μm) |
|---|---|---|---|
| ~0.6 | I | 300 | 20 |
| | J | 150 | 10 |

SEM digital images, together with Table 10, show that the application of an anodic pulse improves the ductility of Al—Mn—Ti alloys. The alloy produced by the waveform I (a direct current waveform) exhibited cracks that were longer and wider than those found on the alloy produced by the cathodic/anodic waveform J. This example illustrates that the application of an anodic pulse can potentially improve the ductility of other Al-based alloys (other than the binary system, Al—Mn).

Thus, these examples show not only that an Al—Mn—Ti alloy can be deposited in a non-aqueous solution, at elevated temperatures, with desirable properties, but also for instance, with ductility enhanced over that produced using direct current.

Strength and Weight

Figure 12:
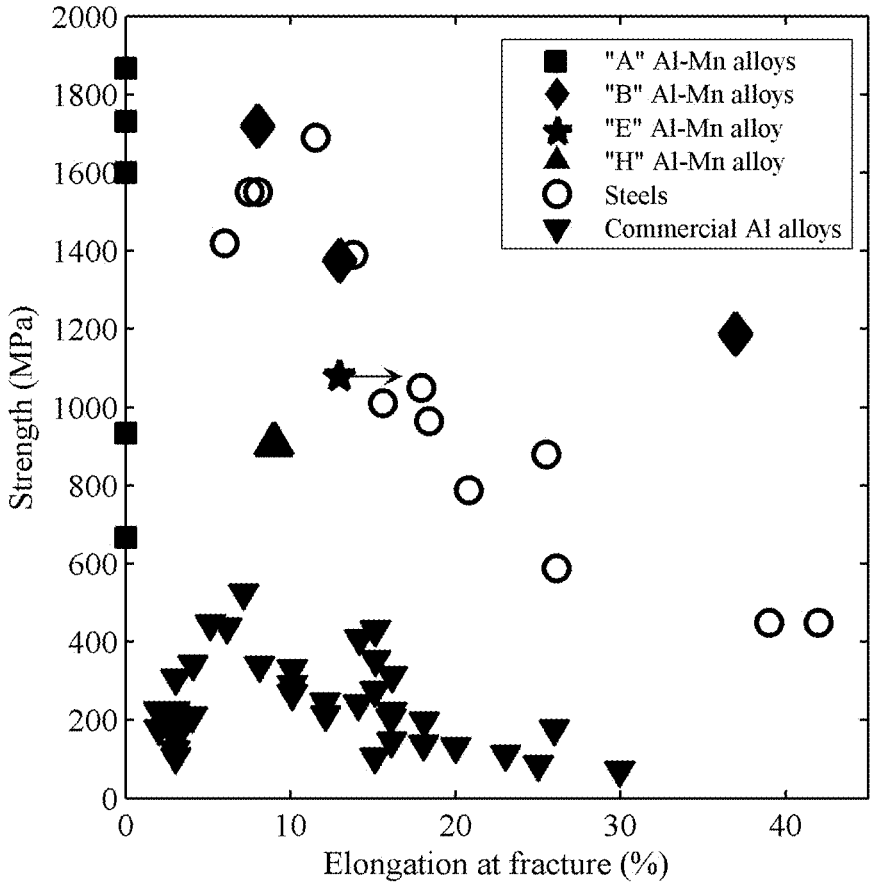
FIG. 12 is a plot graphically showing strength vs. ductility of our A, B, E and H Al—Mn alloys, in comparison with the commercial Al alloys and steels. Arrow pointing to the right indicates that the ductility of the E alloy may be greater than 13%.

The strength of the B waveform Al—Mn alloys has been calculated using the micro-indentation hardness results and the relationship:

$$\sigma_y \approx \frac{H}{3},$$

where $\sigma_y$ is the yield strength and H is the hardness. In the previous discussion on ductility, it is shown that the ductility of the B (cathodic/anodic) alloys containing 6.1, 8.0 and 13.6 at. % Mn are about 37%, 13% and 8%, respectively. FIG. 12 shows a plot of strength vs. ductility of these B alloys, in comparison with the A alloys (direct current), known commercial Al alloys and steels. The strength and ductility of an E (cathodic with off time) and H alloy (cathodic/anodic like B, with shorter anodic pulse duration) are also shown. FIG. 12 shows that Al—Mn alloys electrodeposited with waveforms B, E and H exhibit high strength and good ductility. (The arrow pointing to the right indicates that the E alloy may exhibit ductility even greater than 13%, since it did not crack when strained by 13%.) Because the density of the Al—Mn alloys (~3 g/cm$^3$) are less than one half that of typical steels (~8 g/cm$^3$), FIG. 12 suggests that for the same ductility values, the presently disclosed alloys exhibit specific strengths more than twice as high as steels. Thus, these Al—Mn alloys have potential structural applications, where a good combination of light weight, strength and ductility is required, for instance in the aerospace industry, in sporting goods, or in transportation applications.

Advantages and Improvements Over Existing Methods

The foregoing demonstrates a new composition of matter, which exhibits extremely useful strength and weight properties. The new materials are believed to have a Vickers microhardness between about 1 and about 6 GPa or a tensile yield strength between about 333 and about 2000 MPa, with ductility between about 5% and about 40% or more, as measured using ASTM E290-97a (2004), and density between about 2 g/cm$^3$ and about 3.5 g/cm$^3$. In some embodiments of inventions hereof, the hardness may lie in the range from about 1 to about 10 GPa. In some cases it may lie in the range from about 3 to about 10 GPa, or about 4 to about 10 GPa, or about 5 to about 10 GPa, or about 6 to about 10 GPa. In other embodiments it may lie in the range about 4 to about 7 GPa or between about 5 and about 6 GPa, etc. Thus, an aspect of inventions herein is a deposit as described with any hardness within the range from about 1 GPa to about 10 GPa, and any sub-range within that range. In general, a higher hardness is more desirable from an engineering standpoint, if it can be achieved without sacrificing other factors, including cost.

Similarly, in some embodiments of inventions hereof, the deposit ductility may lie in the range from about 5% elongation at fracture to about 100% elongation at fracture. Thus, a deposit according to an invention hereof may have any ductility within that range. Additionally, useful ranges of ductility for embodiments of inventions hereof include from about 15% to about 100%; and from about 25% to about 100%; and from about 35% to about 100%; and from about 5% to about 50%; and from about 25% to about 60%, or any subrange within the range. In general, a higher ductility is more desirable from an engineering standpoint, if it can be achieved without sacrificing other factors, including cost.

Finally, with respect to density, in some embodiments of inventions hereof, the density may lie in the range from about 2 g/cm$^3$ to about 3.5 g/cm$^3$. In some cases it may lie in the range from about 2.25 to about 3.5 g/cm$^3$, or from about 2.5 to about 3.5 g/cm$^3$, or from about 3 to about 3.5 g/cm$^3$, or from about 2-3 g/cm$^3$. Thus, an aspect of inventions herein is a deposit as described with any density within the range from about 2 g/cm$^3$ and about 3.5 g/cm$^3$ and any sub-range within that range. In general, a lower density (and thus lower overall weight) is more desirable from an engineering standpoint, if it can be achieved without sacrificing other factors, including cost.

These ranges of hardness, tensile yield strength, ductility and density give these new alloys a combination of strength and ductility significantly beyond that of known aluminum alloys, and at the same time they are significantly lighter than steels. The high hardness of these alloys is believed to be due to the very small characteristic microstructural length scales they exhibit, which are below about 100 nm. Small characteristic microstructural length scales generally promote hardness in metals and alloys.

In addition to these highly advantageous strength and weight characteristics, the methods shown herein are capable of providing such alloys with additional features that can be tailored with significant control.

For instance, in contrast to any known methods for electrodeposition of aluminum alloys, it has been found by the present work, that using pulsing, such as anodic and cathodic, and off time, allows synthesis over a wide range of controlled characteristic microstructural length scales, from ~15 nm to ~2500 nm; and the effects of Mn content on characteristic microstructural length scale is more gradual than in the case of using DC waveform (FIG. 8). Thus, using waveforms with different types of pulses, allows a designer to effectively control the characteristic microstructural length scale of deposits of both microcrystalline and nanocrystalline Al alloys. In some embodiments of inventions hereof, the characteristic microstructural length scale may lie in the range from about 15 nm to about 2500 nm. In some cases it may lie in the range from about 50 nm to about 2500 nm, or from about 100 nm to about 2500 nm, or from about 1000 nm to about 2500 nm. In other embodiments it may lie in the range about 15 nm to about 1000 nm or from about 15 nm to about 100 nm, etc. Thus, an aspect of inventions herein is a deposit as described with any characteristic microstructural length scale within the range from about 15 nm to about 2500 nm, and any sub-range within that range. In general, a lower characteristic microstructural length scale may be more desirable from an engineering standpoint, if it can be achieved without sacrificing other factors, including cost. Other target properties can be so controlled as well.

Furthermore, as compared to using processing temperature to affect characteristic microstructural length scale, FIGS. 2 and 11 indicate that by varying the pulse parameters (such as $i_1$, $i_2$, and their ratio $i_2/i_1$ or $t_1$ and $t_2$ and possibly their ratios, and $t_n$) one can use a single electrolytic composition to sequentially electrodeposit alloys of different microstructures and surface morphologies. FIG. 11 shows that by varying $t_n$, composition can be controlled. It is also known that characteristic microstructural length scale is a function of composition. This is shown with reference to FIG. 8. For example, a B alloy with 9.5 at % Mn has a grain size of 30 nm; whereas a "B" alloy with 10.4 at. % Mn has a grain size of 15 nm. Thus, by changing $t_n$, composition, and thus, characteristic microstructural length scale, can be controlled.

Additionally, one can also vary the deposition parameters, such as pulse current density, to create graded microstructures, as the term is defined herein to mean, where any one of ductility, hardness, chemical composition, characteristic microstructural length scale, phase composition or phase arrangement or any combination of them, are controlled through the deposit thickness. For each mechanical or morphological property, there is a relationship between the property, and one or both of the parameters of waveform shape, characterized by the pulse regime, as discussed above, and waveform durations. This relationship can be established for the system under use, by relatively routine experimentation. Once established, it can be used to deposit materials with the desired property degree. Clearly, the use of waveforms containing different types of pulses to alter the microstructure of electrodeposited alloys is versatile and practical and more so than known methods, especially on the industrial scale.

Additionally, across the entire composition range examined (0 to 14 at. % Mn), the alloys exhibit a range of surface morphologies; from highly facetted structures, to less angular features, to a smooth surface, and then to rounded nodules. The tunability of surface morphologies has implications on properties, such as optical luster, coefficient of friction, wettability by liquids, and resistance to crack propagation.

Figure 13:
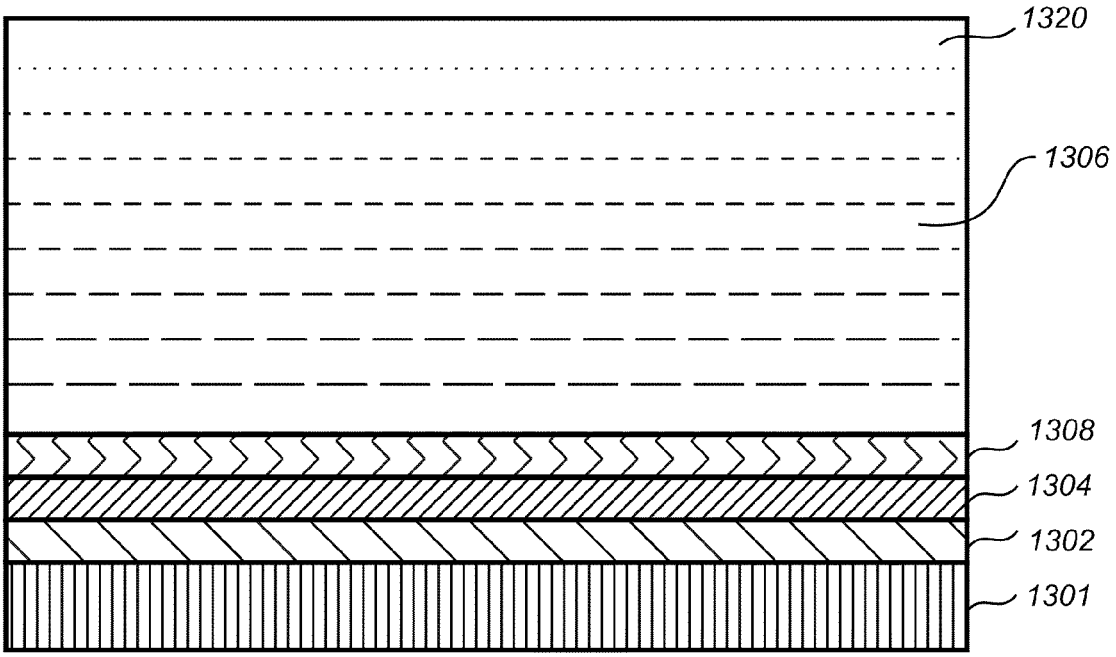
FIG. 13 is a schematic representation in cross-sectional view of a functionally graded deposit, having different properties from one layer to another.

As outlined in previous sections, using waveforms containing different types of pulses would allow not only specifying the target properties for a monolithic deposit. Such processes also allow one to engineer layered composites and graded materials. For instance, as shown schematically with reference to FIG. 13, a deposit 1302 could have a nanometer-scale characteristic microstructural length scale structure at the interface with the substrate 1301 and a micrometer characteristic microstructural length scale structure at the surface 1320, with other structures at layers 1304, 1306 and 1308 in between. Such a deposit would exhibit an excellent combination of high strength (due to its nanometer-scale characteristic microstructural length scale at 1302 near the substrate interface) and good resistance to crack propagation (due to the micrometer-scale characteristic microstructural length scale 1320). Such functionally layered or graded materials would exhibit properties that are unattainable in other deposits. Rather than varying grain size alone, specific variations in ductility can be made from one layer, such as 1302, to another, such as 1306, for whatever reasons a designer may have. Another property that can be graded, either independently or combined with characteristic microstructural length scale, is phase distribution. For instance, some layers can have larger extents of amorphous materials than others may have.

It is important to note that while electrodeposition with waveforms containing different types of pulses has been reduced to practice in the Al—Mn and Al—Mn—Ti systems, it is believed to be widely applicable to other electrodeposited multi-component Al-based alloys. Possible alloying elements include La, Pt, Zr, Co, Ni, Fe, Cu, Ag, Mg, Mo, Ti, W, Co, Li and Mn, among many others that would be identifiable by those skilled in the art.

The forgoing has discussed galvanic electrodeposition, where current is applied to cause the deposition. Additionally, similar results are believed to be obtainable in the case of potentiostatic electrodeposition, where instead of $i_1$ and $i_2$, the relevant processing variables would be $V_1$ and $V_2$, where V denotes the applied voltage. Thus, for any of the results discussed above, it is possible to use, rather than a pulsed current, a pulsed voltage of the same sorts of waveforms. It is believed that the same properties can be affected in generally the same manners.

The foregoing discussion also specifically described deposition from a specific electrolyte, involving the ionic liquid EmImCl. The discussion applies equally to deposition from any other non-aqueous electrolyte, including organic electrolytes, aromatic solvents, toluene, alcohol, liquid hydrogen chloride, or molten salt baths. Additionally, there are many ionic liquids that may be used as a suitable electrolyte, including those that are protic, aprotic, or zwitterionic. Examples include 1-ethyl-3-methylimidazolium chloride, 1-ethyl-3-methylimidazolium N,N-bis(trifluoromethane) sulphonamide, or liquids involving imidazolium, pyrrolidinium, quaternary ammonium salts, bis(trifluoromethanesulphonyl)imide, bis(fluorosulphonyl)imide, or hexafluorophosphate. The discussion above applies to such electrolytes, and to many other suitable electrolytes known and yet to be discovered.

The foregoing discussion applies to the use of aluminum chloride as a salt species from which Al ions are supplied to the bath, and manganese chloride as a salt species from which Mn ions are supplied to the plating bath. The discussion also applies to other ion sources, including but not limited to metal sulfates, metal sulfamates, metal-containing cyanide solutions, metal oxides, metal hydroxides and the like. In the case of Al, $AlF_x$ compounds may be used, with x an integer (usually 4 or 6).

The foregoing discussion also specifically described pulse regimes and waveform modules comprising pulses singularly-valued in current, or in which each pulse involves a period of constant applied current, where the waveforms were square waveforms. The discussion applies equally to waveforms that involve segments or pulses that are not of constant current, but which are, for example, ramped, sawtoothed, oscillatory, sinusoidal, or some other shape. For any such waveform, it is possible to measure an average current $i_t$ over a duration $t_1$, and a second average current $i_2$ over a second duration $t_2$ and to then make use of these average current values in the same manner as the current values $i_1$, $i_2$ are used, as discussed above. The above discussion extends to such cases, and it is believed that the same general trends would result.

This section summarizes some of the specific examples addressed above.

The surface morphologies of the A alloys show an abrupt transition from highly facetted structures to rounded nodules at ~8 at. %. The surface morphologies of the B alloys show a gradual transition from highly facetted structures to less angular and smaller structures; and then to a smooth and almost featureless surface before rounded nodules start to appear. Thus, use of the B type waveform would allow a smooth control over surface morphology, if used in conjunction with varying Mn content of the electrolyte.

Cathodic/anodic pulsing allows a more continuous range of characteristic microstructural length scale to be synthesized, in both the micrometer and nanometer regime, as compared to using direct current. Using a cathodic/anodic pulsing, a desired characteristic microstructural length scale can be achieved by choosing the Mn content that corresponds with that characteristic microstructural length scale.

The hardness of the alloys under discussion increases with Mn content, for pulsed using a B type waveform. This means that hardness can also be tailored using a pulsed regime, as can be characteristic microstructural length scale.

In general, alloy composition is found to relate directly to electrolyte composition, with the general rule that for some ranges of $MnCl_2$ content in the electrolyte, a cathodic/anodic or a cathodic/off-time pulsing regime reduces the Mn content in the deposited Al—Mn alloy.

For positive values of $i_2$ (i.e. waveforms A (DC (6 and 6 mA/cm$^2$)), C cathodic pulsing at 6 and 3 mA/cm$^2$ and D cathodic pulsing at 6 and 1 mA/cm$^2$), decreasing the magnitude of the positive pulse current causes the ductility to increase. For the E, cathodic and off time 6 and 0 mA/cm$^2$, cathodic/anodic B 6 and −3 mA/cm$^2$ and F 6 and −1 mA/cm$^2$ alloys, as $i_2$ becomes more negative, the ductility of the alloy decreases. Thus, for this system, there is a maximum ductility somewhere near to $i_2$=0 (cathodic with off time). Regarding the pulse duration, it has been found for cathodic/anodic pulses, that for the same pulse current density $i_2$ (i.e. −3 mA/cm$^2$), increasing the duration of the negative current pulse $t_n$ causes the ductility of the alloys to increase. Providing a cathodic pulse and then another pulse, either cathodic, anodic, or off-time, and of varying durations, provides a more ductile alloy than would direct current.

While particular embodiments have been shown and described, it will be understood by those skilled in the art that various changes and modifications may be made without departing from the disclosure in its broader aspects. It is intended that all matter contained in the above description and shown in the accompanying drawings shall be interpreted as illustrative and not in a limiting sense.

SUMMARY

An important embodiment of an invention hereof is a method for depositing an alloy comprising aluminum. The method comprises the steps of: providing a non-aqueous electrolyte comprising dissolved species of aluminum; providing a first electrode and a second electrode in the liquid, coupled to a power supply; and driving the power supply to deliver electrical power to the electrodes, having waveforms comprising modules comprising at least two pulses. The first pulse has a cathodic power with an amplitude of $i_1$ that is positive, applied over a duration $t_1$, and the second pulse has a power of value $i_2$ that is applied over a duration $t_2$. Further, both $t_1$ and $t_2$ are greater than about 0.1 milliseconds and less than about 1 second in duration, and further, the ratio $i_2/i_1$ is less than about 0.99 and greater than about −10. As a result, a deposit comprising aluminum arises upon the second electrode.

According to one important embodiment, the supply supplies electrical power having waveforms with modules comprising an anodic pulse. According to a related embodiment, the supply supplies electrical power having waveforms with modules comprising off-time and the cathodic pulse. Alternatively, the supply supplies electrical power having waveforms with modules comprising at least two cathodic pulses of different magnitudes.

The supplied power may be pulsed current or pulsed voltage, or a combination thereof.

According to one useful embodiment, the at least one other element comprises manganese.

The pulsed power may have a repeating waveform with modules having a duration of between about 0.2 ms and about 2000 ms.

A very useful embodiment is such a method that creates a deposit having a characteristic microstructural length scale of less than about 100 nm.

Yet another embodiment obtains where there exists a correlation between the electrolyte composition with respect to the at least one other element and a property of a formed alloy, which correlation is continuous over a range of practical use of the deposit. The method embodiment further comprises the steps of: based on the correlation, noting the composition with respect to the at least one other element that corresponds to a target degree for the property; and, where the non-aqueous electrolyte comprises a liquid with the corresponding composition. The liquid may be an ionic liquid, for instance 1-ethyl-3-methylimidazolium chloride.

With a related method embodiment, the property of the formed alloy comprises average characteristic size of surface features. With yet another related embodiment, the property of the formed alloy comprises surface morphology. The surface morphology can range from highly facetted structures, to less angular features, to a smooth surface, and to rounded nodules.

For still another related method embodiment, the property of the formed alloy comprises average characteristic microstructural length scale.

The target degree for average characteristic microstructural length scale may be between approximately 15 nm and approximately 2500 nm, and typically between about 15 nm and about 100 nm, or between about 100 nm and about 2500 nm.

Another important class of embodiments is where there exists a correlation between the value of at least one of: the pulse amplitudes, the amplitude ratios, and duration of the pulses and a degree of a property of a formed alloy. The correlation is continuous over a range of practical use of the deposit. This method further comprises the steps of: based on the correlation, noting the value of at least one of amplitude, amplitude ratio or duration that corresponds to a target degree for the property. Noting same, the power supply supplies electrical power with modules having pulses having the noted value of the at least one of the amplitude, amplitude ratio or duration that corresponds to a target degree for the property. Thus the deposit at the second electrode has the target degree for the property.

For a method directly related to this embodiment, the step of noting the value of at least one of the amplitude, amplitude ratio and duration comprises noting a second value of at least one of the amplitude, amplitude ratio and duration that correspond to a second target degree for the property, and the step of driving the power supply comprises alternately supplying electrical power with modules having pulse, having the value of the first at least one amplitude, amplitude ratio and duration that corresponds to a first target degree for the property, and then supplying electrical power with modules having pulses, having the value of the second at least one amplitude, amplitude ratio and duration that corresponds to the second target degree for the property. Thus an article is produced having a structure with regions that exhibit the property with the first target degree, and with regions that exhibit the property with the second target degree.

With a similar method embodiment power supply delivers electrical power to the electrodes for a first period of time, as described above, with pulses having powers $i_1$ and $i_2$ for durations $t_1$ and $t_2$, respectively, thereby producing at the cathode a first portion of the deposit with at least one property chosen from the group consisting of hardness, ductility, composition, characteristic microstructural length scale, and phase arrangement, having a first degree. The power supply then delivers power to the electrodes for a second period of time, having waveforms comprising modules comprising at least two pulses, the first pulse having a cathodic power with an amplitude of $i_{1*}$ that is positive, applied over a duration $t_{1*}$, and the second pulse having a power of value $i_{2*}$ that is applied over a duration $t_{2*}$. Both $t_{1*}$ and $t_{2*}$ are greater than about 0.1 milliseconds and less than about 1 second in duration. The ratio $i_{2*}/i_{1*}$ is less than about 0.99 and greater than about −10. At least one of the following inequalities is true: $i_1 \neq i_{1*}$; $i_2 \neq i_{2*}$; $t_1 \neq t_{1*}$; and $t_2 \neq t_{2*}$. A second portion of the deposit is produced at the cathode with the at least one property having a second, different degree.

Yet another important embodiment of an invention hereof is a composition of matter that is an alloy of at least one element that has a lower reduction potential than water and at least one additional element. A first layer, has a property having a first parameter degree. At least one additional layer has the property, having a second, different parameter degree. The property is selected from the group consisting of: hardness, ductility, composition, characteristic microstructural length scale, and phase arrangement. Adjacent the first layer, and in contact therewith, is a second layer having a the same property, such as crystalline structure with a second parameter degree for that property, such as average grain size, which second parameter degree differs from the first parameter degree.

Yet another beneficial embodiment of an invention hereof is a composition of matter comprising: an alloy comprising aluminum of at least about 50 at. % and preferably at least about 70 at. % aluminum, and at least one additional element. The alloy has: a Vickers microhardness between about 1 GPa and about 10 GPa or a tensile yield strength between about 333 MPa and about 3333 MPa ductility between about 5% and about 100%; and density between about 2 g/cm$^3$ and about 3.5 g/cm$^3$.

With this embodiment, the at least one additional element may comprise manganese. Further, it may be an at least partially amorphous structure.

A related embodiment has a characteristic microstructural length scale of less than about 100 nm.

With related useful embodiments, the at least one additional element may be selected from the group consisting of: La, Pt, Zr, Co, Ni, Fe, Cu, Ag, Mg, Mo, Ti and Mn.

The Vickers hardness may exceed about 3 GPa or about 4 GPa or about 5 GPa.

The ductility may exceed about 20%, or about 35%.

Many techniques and aspects of the inventions have been described herein. The person skilled in the art will understand that many of these techniques can be used with other disclosed techniques, even if they have not been specifically described in use together.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of articles of manufacture, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

What is claimed is:

1. A method for depositing an alloy comprising aluminum and manganese, the method comprising the steps of:

a. providing a non-aqueous electrolyte comprising dissolved species of aluminum and manganese the non-aqueous electrolyte comprising an ionic liquid;

b. providing a first electrode and a second electrode in the electrolyte, coupled to a power supply; and c. driving the power supply to deliver electrical power to the electrodes, the electrical power having waveforms comprising a plurality of modules, at least one module comprising at least two pulses, the first pulse having a cathodic power with an amplitude of $i_1$ that is positive, applied over a duration $t_1$, and the second pulse having an amplitude of value $i_2$ that is applied over a duration $t_2$, further where both $t_1$ and $t_2$ are greater than about 0.1 milliseconds and less than about 1 second in duration, and wherein the ratio $i_2/i_1$ is greater than about −0.625 and less than zero (0);

whereby an alloy deposit comprising aluminum and manganese arises upon the second electrode, the alloy deposit having a ductility of between about 5% and about 100%.

2. The method of claim 1, the deposit comprising at least about 50% Al by weight.

3. The method of claim 1, wherein the step of driving the power supply further comprises driving the power supply to supply electrical power such that one of the plurality of modules comprises off-time and an additional cathodic pulse.

4. The method of claim 1, wherein the step of driving the power supply further comprises driving the power supply to supply electrical power such that one of the plurality of modules comprises at least two cathodic pulses of different magnitudes.

5. The method of claim 1, the step of driving comprising driving the power supply with a non-constant electrical power having a repeating waveform with modules having a duration of between about 0.2 ms and about 2000 ms.

6. The method of claim 1, the deposit having a characteristic microstructural length scale of less than about 100 nm.

7. The method of claim 1, where the step of providing an electrolyte further comprises providing a non-aqueous electrolyte comprising dissolved species of at least one other element that is not aluminum and manganese.

8. The method of claim 7, wherein there exists a correlation between the electrolyte composition with respect to the at least one other element and a property of a formed alloy, which correlation is continuous over a range of practical use of the deposit, further comprising the steps of:

a. based on the correlation, determining the composition with respect to the at least one other element that corresponds to a target degree for the property; and b. the step of providing a non-aqueous electrolyte comprises providing an electrolyte with the corresponding composition.

9. The method of claim 8, the property of the formed alloy comprising average characteristic size of surface features.

10. The method of claim 8, the property of the formed alloy comprising surface morphology.

11. The method of claim 10, the property comprising surface morphology, the target degree comprising surface morphology ranging from highly facetted structures, to less angular features, to a smooth surface, and to rounded nodules.

12. The method of claim 8, the property of the formed alloy comprising average characteristic microstructural length scale.

13. The method of claim 12, the target value for average characteristic microstructural length scale being between approximately 15 nm and approximately 2500 nm.

14. The method of claim 1, wherein there exists a correlation between the value of at least one of: the pulse amplitudes, the amplitude ratios, and duration of the pulses; and a degree of a property of a formed alloy, which correlation is continuous over a range of practical use of the deposit, further comprising the steps of:

a. based on the correlation, determining the value of at least one of amplitude, amplitude ratio or duration that corresponds to a target degree for the property; and b. the step of driving the power supply comprising driving the power supply to supply electrical power with modules having pulses, having the determined value of the at least one of the amplitude, amplitude ratio or duration that corresponds to a target degree for the property, to achieve the deposit at the second electrode having the target degree for the property.

15. The method of claim 14, the step of determining the value of at least one of the amplitude, amplitude ratio and duration comprising determining a second value of at least one of the amplitude, amplitude ratio and duration that correspond to a second target degree for the property, and the step of driving the power supply comprising alternately driving the power supply to supply electrical power with modules having pulses, having the value of the first at least one amplitude, amplitude ratio and duration that corresponds to a first target degree for the property, and then driving the power supply to supply electrical power with modules having pulses, having the value of the second at least one amplitude, amplitude ratio and duration that corresponds to the second target degree for the property, whereby an article is produced having a structure with regions that exhibit the property with the first target degree, and with regions that exhibit the property with the second target degree.

16. The method of claim 1, comprising:

the step of driving the power supply comprising driving the power supply to deliver electrical power to the electrodes for a first period of time, thereby producing at the cathode a first portion of the deposit with at least one property chosen from the group consisting of hardness, ductility, composition, characteristic microstructural length scale, and phase arrangement having a first degree;

and driving the power supply to deliver electrical power to the electrodes for a second period of time, having waveforms comprising modules comprising at least two pulses, the first pulse having a cathodic power with an amplitude of $i_{1*}$ that is positive, applied over a duration $t_{1*}$, and the second pulse having a power of value $i_{2*}$ that is applied over a duration $t_{2*}$, further where both $t_{1*}$ and $t_{2*}$ are greater than about 0.1 milliseconds and less than about 1 second in duration, and further where the ratio $i_{2*}/i_{1*}$ is less than about 0.99 and greater than about −10, and where at least one of the following inequalities is true: $i_1 \neq i_{1*}$; $i_2 \neq i_{2*}$; $t_1 \neq t_{1*}$; $t_2 \neq t_{2*}$; producing at the cathode a second portion of the deposit with the at least one property having a second, different degree.

17. The method of claim 1, the electrical power comprising electrical current.

18. The method of claim 1, the non-aqueous electrolyte comprising 1-ethyl-3-methylimidazolium chloride.

19. The method of claim 1, wherein the ratio $i_2/i_1$ is greater than about −0.5.

* * * * *